US006652439B2

(12) United States Patent
Herman et al.

(10) Patent No.: US 6,652,439 B2
(45) Date of Patent: Nov. 25, 2003

(54) DISPOSABLE ROTOR SHELL WITH INTEGRAL MOLDED SPIRAL VANES

(75) Inventors: Peter K. Herman, Cookeville, TN (US); Kevin South, Cookeville, TN (US); Hendrik N. Amirkhanian, Cookeville, TN (US); Richard Jensen, deceased, late of Cookeville, TN (US), by Shirley Ann Jensen, Executrix

(73) Assignee: Fleetguard, Inc., Nashville, TN (US)

( * ) Notice: Subject to any disclaimer, the term of this patent is extended or adjusted under 35 U.S.C. 154(b) by 81 days.

(21) Appl. No.: 09/909,601

(22) Filed: Jul. 20, 2001

(65) Prior Publication Data

US 2002/0049126 A1 Apr. 25, 2002

Related U.S. Application Data

(63) Continuation-in-part of application No. 09/776,378, filed on Feb. 2, 2001, now Pat. No. 6,540,653, which is a continuation-in-part of application No. 09/542,723, filed on Apr. 4, 2000, now abandoned.

(51) Int. Cl.[7] ..... B04B 1/04; B04B 9/06

(52) U.S. Cl. ..... 494/75; 494/49; 494/60; 494/68; 494/79; 494/901; 210/168; 184/6.24

(58) Field of Search ..... 210/168, 380.1; 184/6.24; 494/49, 60, 67, 68, 74, 75, 64, 79, 901, 70

(56) References Cited

U.S. PATENT DOCUMENTS

| | | | | |
|---|---|---|---|---|
| 661,943 | A | 11/1900 | Arend | |
| 707,132 | A | 8/1902 | Marsh | |
| 715,493 | A | 12/1902 | Lundstrom | |
| 1,006,622 | A | 10/1911 | Bailey | |
| 1,208,960 | A | 12/1916 | Hennerich | |
| 1,719,522 | A | 7/1929 | Sharples | |
| 2,199,849 | A | 5/1940 | Bryson | |
| 2,578,485 | A | 12/1951 | Nyrop | |
| 2,819,014 | A | 1/1958 | Zabriskie, Jr. | |
| 2,941,872 | A | 6/1960 | Pilo et al. | |
| 3,563,454 | A | 2/1971 | Saget | |
| 4,262,841 | A | 4/1981 | Berber et al. | |
| 4,353,499 | A | 10/1982 | Simonds | |
| 5,575,912 | A | 11/1996 | Herman et al. | |
| 5,637,217 | A | 6/1997 | Herman et al. | |
| 6,017,300 | A | 1/2000 | Herman | |
| 6,019,717 | A | 2/2000 | Herman | |
| 6,074,336 | A | 6/2000 | Purvey | 494/49 |
| 6,183,407 | B1 | 2/2001 | Hallgren et al. | |
| 6,196,962 | B1 | 3/2001 | Purvey et al. | |
| 6,364,822 | B1 * | 4/2002 | Herman et al. | 494/49 |
| 2002/0045526 | A1 | 4/2002 | Herman et al. | |

FOREIGN PATENT DOCUMENTS

| | | | |
|---|---|---|---|
| EP | 1 142 644 A2 | 10/2001 | |
| GB | 16855 | 8/1904 | |
| GB | 27875 | 12/1904 | |
| GB | 2 077 610 A | 6/1980 | |
| GB | 2 328 891 A | 8/1998 | |
| SE | 18846 | 11/1903 | |
| SU | 0721126 | 3/1980 | |
| WO | WO 98/46361 | 10/1998 | B04B/5/00 |
| WO | WO 99/51353 | 10/1999 | |
| WO | WO 00/23194 | 4/2000 | B04B/1/06 |
| WO | WO 01/74492 A2 | 10/2001 | |

* cited by examiner

*Primary Examiner*—David A. Reifsnyder
(74) *Attorney, Agent, or Firm*—Woodard, Emhardt, Moriarty, McNett & Henry LLP

(57) ABSTRACT

A self-driven centrifuge for separating particulate matter out of a circulating liquid includes a base plate and a rotor shell. The base plate has a center tube extending therefrom along a longitudinal axis. The center tube is constructed and arranged to deliver fluid containing particulate matter. A rotor shell has an inner cavity and a plurality of spiral vanes extending along the longitudinal axis within the inner cavity. The spiral vanes extend spirally around the center tube and the spiral vanes are integrally formed with the rotor shell. In one form, spiral vanes are also formed on the base plate and are nested in between the spiral vanes of the rotor shell.

29 Claims, 24 Drawing Sheets

DISPOSABLE ROTOR SHELL WITH INTEGRAL MOLDED SPIRAL VANES

REFERENCE TO RELATED APPLICATIONS

This application is a continuation-in-part (CIP) patent application of U.S. Ser. No. 09/776,378, filed Feb. 2, 2001, entitled IMPROVED UNITARY SPIRAL VANES CENTRIFUGE MODULE, now U.S. Pat. No. 6,540,653, which is a CIP of Ser. No. 09/542,723, filed Apr. 4, 2000, entitled SELF-DRIVEN CENTRIFUGE WITH VANE MODULE, now abandoned, both of which are incorporated herein by reference in their entirety.

BACKGROUND OF THE INVENTION

The present invention relates generally to the continuous separation of particulate matter from a flowing liquid by the use of a centrifugal field. More specifically the present invention relates to the use of spiral plates or vanes within the centrifuge bowl in cooperation with a suitable propulsion arrangement for self-driven rotation of the spiral vanes. In one embodiment of the present invention, the propulsion arrangement includes the use of jet nozzles. In other embodiments of the present invention, the specific shape and style of the spiral vanes are modified, including the embodiment of flat (planar) plates. Also, in these other embodiments, the styling of the cooperating components is modified, thereby providing different final assembly embodiments.

Since the use of spiral vanes in the preferred embodiment of the present invention is a design change to the prior art technology employing a cone-stack subassembly as the basis for particulate matter separation from the flowing liquid, a review of this cone-stack technology may be helpful in appreciating the differences between the present invention and the prior art and the benefits afforded by the present invention.

U.S. Pat. No. 5, 575,912, which issued Nov. 19, 1996 to Herman et al., discloses a bypass circuit centrifuge for separating particulate matter out of a circulating liquid. The construction of this centrifuge includes a hollow and generally cylindrical centrifuge bowl which is arranged in combination with a base plate so as to define a liquid flow chamber. A hollow center tube axially extends up through the base plate into the hollow interior of the centrifuge bowl. The bypass circuit centrifuge is designed so as to be assembled within a cover assembly and a pair of oppositely-disposed tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The stacked array of truncated cones is sandwiched between a top plate positioned adjacent to the top portion of the centrifuge bowl and a bottom plate which is positioned closer to the base plate. The incoming liquid flow exits the center tube through a pair of oil inlets and from there flows through the top plate. The top plate in conjunction with ribs on the inside surface of the centrifuge bowl accelerate and direct this flow into the upper portion of the stacked array of truncated cones. As the flow passes radially inward through the channels created between adjacent cones, particle separation occurs. Upon reaching the inner diameter of the cones, the liquid continues to flow downwardly to the tangential flow nozzles.

U.S. Pat. No. 5,637,217, which issued Jun. 10, 1997 to Herman et al., is a continuation-in-part patent based upon U.S. Pat. No. 5,575,912. The U.S. Pat. No. 5,637,217 discloses a bypass circuit centrifuge for separating particulate matter out of a circulating liquid. The construction of this centrifuge includes a hollow and generally cylindrical centrifuge bowl which is arranged in combination with a base plate so as to define a liquid flow chamber. A hollow center tube axially extends up through the base plate into the hollow interior of the centrifuge bowl. The bypass circuit centrifuge is designed so as to be assembled within a cover assembly and a pair of oppositely-disposed tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The incoming liquid flow exits the center tube through a pair of oil inlets and from there is directed into the stacked array of cones. In one embodiment, a top plate in conjunction with ribs on the inside surface of the centrifuge bowl accelerate and direct this flow into the upper portion of the stacked array. In another embodiment the stacked array is arranged as part of a disposable subassembly. In each embodiment, as the flow passes through the channels created between adjacent cones, particle separation occurs as the liquid continues to flow downwardly to the tangential flow nozzles.

U.S. Pat. No. 6,017,300, which issued Jan. 25, 2000 to Herman discloses a cone-stack centrifuge for separating particulate matter out of a circulating liquid. The construction of this centrifuge includes a cone-stack assembly which is configured with a hollow rotor hub and is constructed to rotate about an axis. The cone-stack assembly is mounted onto a shaft center tube which is attached to a hollow base hub of a base assembly. The base assembly further includes a liquid inlet, a first passageway, and a second passageway which is connected to the first passageway. The liquid inlet is connected to the hollow base hub by the first passageway. A bearing arrangement is positioned between the rotor hub and the shaft center tube for rotary motion of the cone-stack assembly. An impulse-turbine wheel is attached to the rotor hub and a flow jet nozzle is positioned so as to be directed at the turbine wheel. The flow jet nozzle is coupled to the second passageway for directing a flow jet of liquid at the turbine wheel in order to impart rotary motion to the cone-stack assembly. The liquid for the flow jet nozzle enters the cone-stack centrifuge by way of the liquid inlet. The same liquid inlet also provides the liquid which is circulated through the cone-stack assembly.

U.S. Pat. No. 6,019,717, which issued Feb. 1, 2000 to Herman is a continuation-in-part patent based upon U.S. Pat. No. 6,017,300. The U.S. Pat. No. 6,019,717 discloses a construction which is similar to the construction of the parent patent, but which includes the addition of a honeycomb-like insert which is assembled into the flow jet nozzle in order to reduce inlet turbulence and improve the turbine efficiency.

The increased separation efficiency provided by the inventions of the U.S. Pat. Nos. 5,575,912; 5,637,217; 6,017,300; and 6,019,717 is attributed in part to reduced sedimentation distance across the cone-to-cone gap. During the conception of the present invention, it was theoretically concluded that an equivalent effect could be achieved by converting the cone-stack subassembly into a radiating series of spiral vanes or plates with a constant axial cross-section geometry. The spiral vanes of the present invention, as described in some of the invention embodiments which will be described in greater detail, are integrally joined to a central hub and a top plate. In another related embodiment, the spiral vanes are also integrally joined to the liner shell as a unitary component. The preferred embodiment describes these combinations of component parts as a unitary and molded combination such that there is a single component. The top plate works in conjunction with acceleration vanes on the inner surface of the shell so as to route the exiting flow from the center portion of the centrifuge to the outer peripheral edge portion of the top plate where flow inlet holes are located. A divider shield located adjacent the outer periphery of the top plate functions to prevent the flow from diverting or bypassing the inlet holes and thereafter enter the spiral vane module through the outside perimeter between the vane gaps. If the flow was permitted to travel in this fashion, it could cause turbulence and some particle re-entrainment, since particles are being ejected in this zone. In the configuration of each spiral vane of certain embodiments, the outer peripheral edge is formed with a turbulence shield which extends the full axial length of each spiral vane as a means to further reduce fluid interaction between the outer quiescent sludge collection zone and the gap between adjacent spiral vanes where liquid flow and particle separation are occurring. Following the theoretical conception of this embodiment, an actual reduction to practice occurred. Initial testing was conducted in order to confirm the benefits and improvements offered by this first embodiment. In another embodiment of the present invention where the spiral vanes are made integral with the liner shell, it has been learned that other improvements are possible. For example, whenever there is an annular clearance space of some measurable size, between the inside surface of the liner shell or rotor shell and the outer edges of either a cone stack or spiral vane module, a "sludge zone" is created. When this annular clearance space or sludge zone is free from any intruding objects, it will be disturbed by unhindered tangential and axial motion of the fluid, even during steady state operating conditions. These secondary flows cause separated sludge and particulate to become re-entrained, resulting in reduced separation performance. By extending the vanes to a point of contact with the liner shell or at least to a point of near abutment, the flow is limited into axial channels and this prevents any tangential motion of fluid relative to the rotors rotation. Less re-entrained sludge and particulate contributes to improved performance.

The commercial embodiments of the inventions disclosed in the U.S. Pat. Nos. 5,575,912; 5,637,217; 6,017,300; and 6,019,717 use a cone-stack subassembly which includes a stack of between twenty and fifty individual cones which must be separately molded, stacked, and aligned before assembly with the liner shell and base plate or, in the case of a disposable rotor design, with the hub or spool portion. This specific configuration results in higher tooling costs due to the need for large multi-cavity molds and higher assembly costs because of the time required to separately stack and align each of the individual cones. The "unitary molded spiral" concept of the present invention enables the replacement of all of the individual cones of the prior art with one molded component. The spiral vanes which comprise the unitary module can be simultaneously injection molded together with the hub portion for the module and the referenced top plate. Alternatively, these individual spiral vanes can be extruded with the hub and then assembled to a separately molded top plate. Even in this alternative approach to the manufacturing method of the present invention, the overall part count would be reduced from between twenty and fifty separate pieces to two pieces.

The present invention provides an alternative design to the aforementioned cone-stack technology. The design novelty and performance benefits of the self-driven, cone-stack designs as disclosed in U.S. Pat. Nos. 5,575,912; 5,637,217; 6,017,300; and 6,019,717 have been demonstrated in actual use. While some of the "keys" to the success of these earlier inventions have been retained in the present invention, namely the self-driven concept and the reduced sedimentation distance across the inter-cone gaps, the basic design has changed. The replacement of the vertical stack of individually molded cones with a single spiral vane module is a significant structural change and is believed to represent a novel and unobvious advance in the art.

SUMMARY OF THE INVENTION

One embodiment of the present invention concerns a centrifuge that includes a base plate and rotor shell. The base plate has a center tube extending therefrom along a longitudinal axis. The center tube is constructed and arranged to deliver fluid. The rotor shell defines an inner cavity and the shell has a plurality of spiral vanes extending along the longitudinal axis within the inner cavity and extending spirally around the center tube. The vanes are integrally formed with the rotor shell.

A further form concerns a rotor shell for a centrifuge. The rotor shell includes an outer shell portion that has an annular engagement edge constructed and arranged to engage a lower shell portion. The outer shell portion defines an inner cavity, and the outer shell has a longitudinal axis. A plurality of spiral vanes are integrally formed within the outer shell. The spiral vanes extend spirally in the inner cavity and extend along the longitudinal axis.

Another form of the present invention concerns a method of manufacturing a centrifuge. A rotor shell is molded with a plurality of spiral vanes integrally formed with the rotor shell. The rotor shell defines an inner cavity and the spiral vanes extend spirally in the inner cavity. The spiral vanes have an inner edge that define a center tube passage. A base plate with a center tube is provided and the center tube is inserted into the center tube passage.

One object of the present invention is to provide an improved self-driven centrifuge which includes a separation vane module Related objects and advantages of the present invention will be apparent from the following description.

DESCRIPTION OF THE PREFERRED EMBODIMENTS

Figure 1:
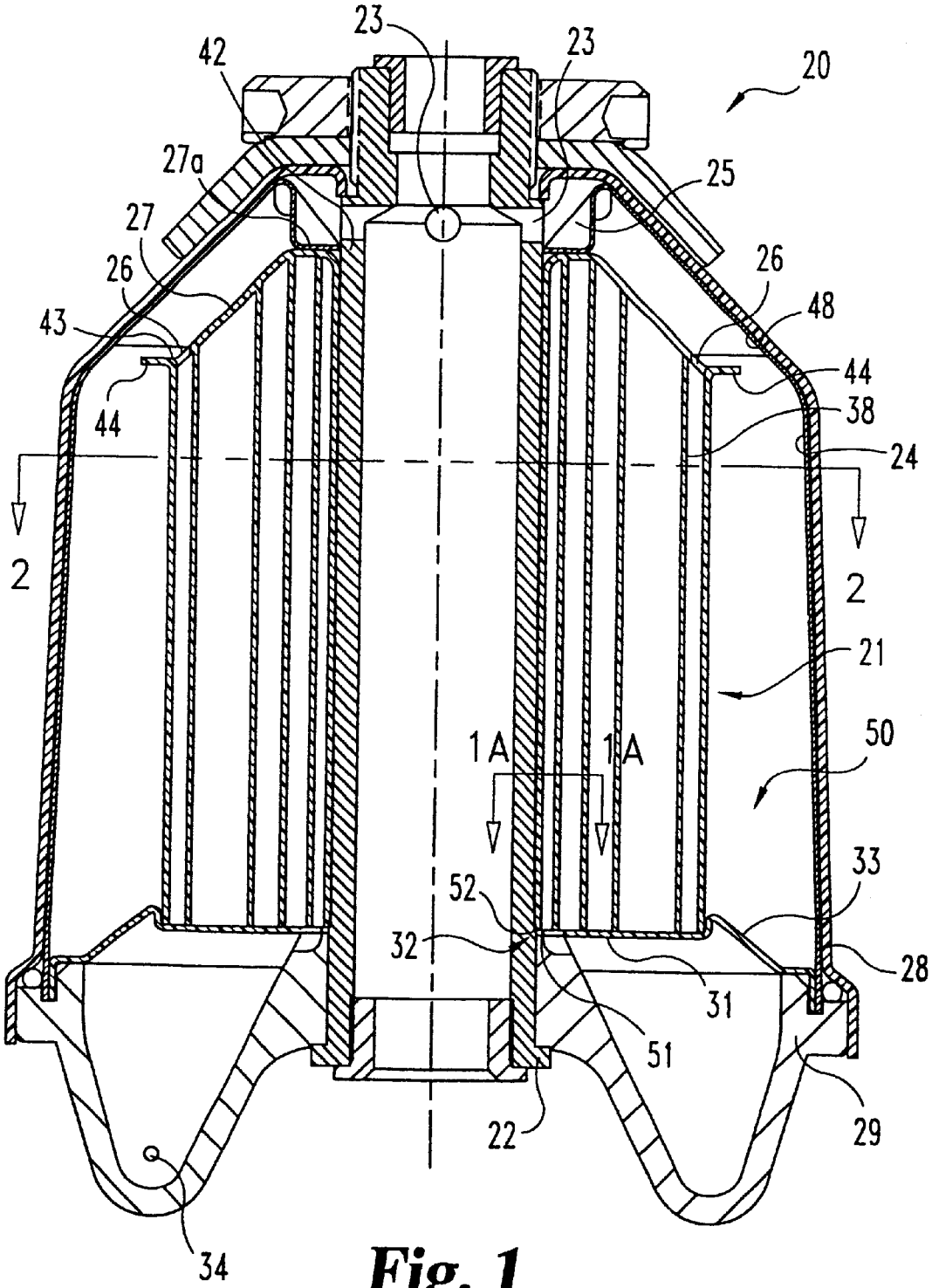
FIG. 1 is a front elevational view in full section of a self-driven centrifuge according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
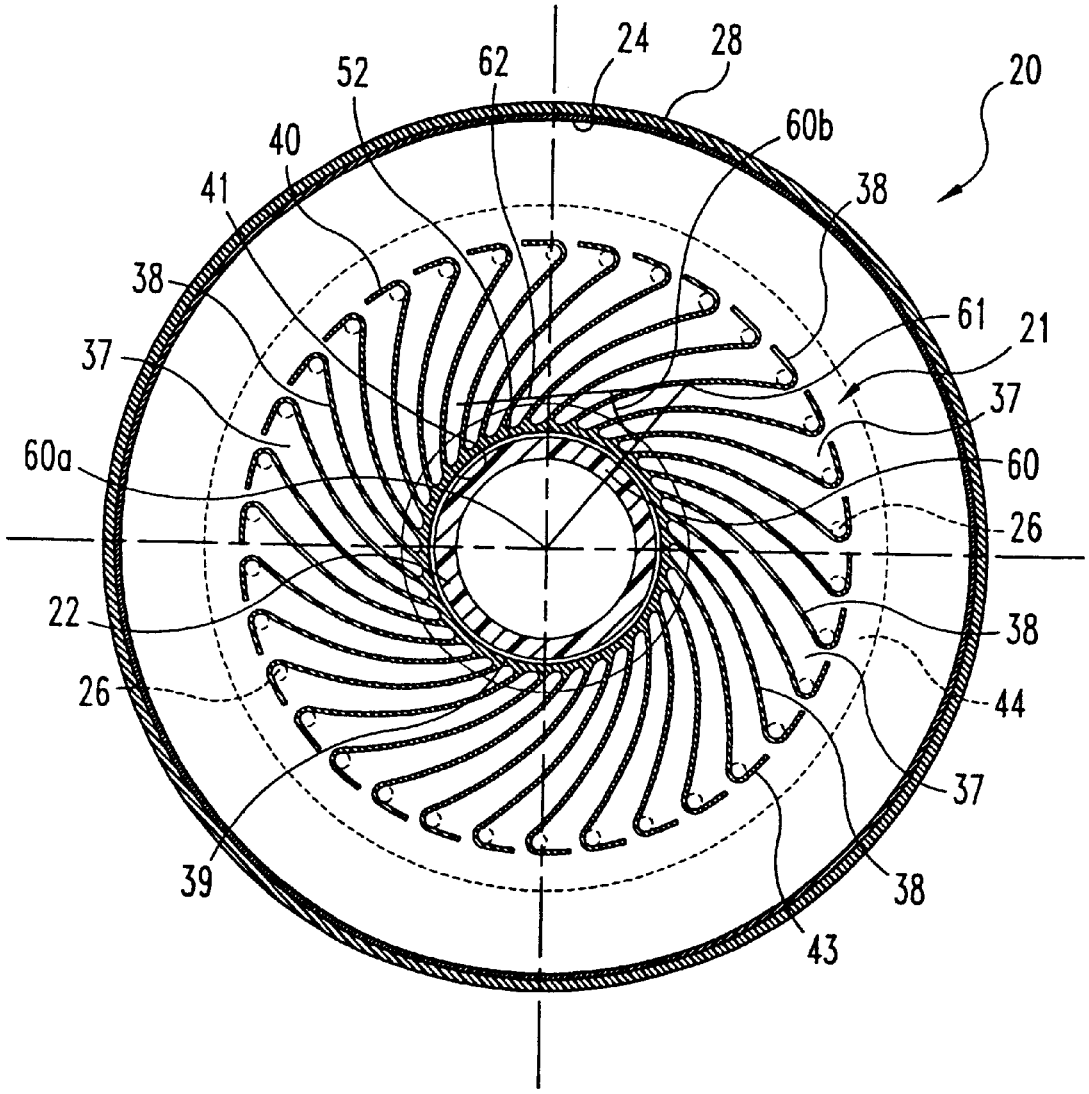
FIG. 2 is a top plan view in full section of the FIG. 1 centrifuge as viewed along line 2—2 in FIG. 1.

Referring to FIGS. 1 and 2, there is illustrated a self-driven centrifuge 20 with a unitary, spiral vane module 21, which replaces the cone-stack subassembly of earlier designs, such as those earlier designs disclosed in U.S. Pat. Nos. 5,575,912; 5,637,217; 6,017,300; and 6,019,717. U.S. Pat. No. 5,575,912 which issued Nov. 19, 1996 to Herman et al. is hereby incorporated by reference. U.S. Pat. No. 5,637,217 which issued Jun. 10, 1997 to Herman et al. is hereby incorporated by reference. U.S. Pat. No. 6,017,300 which issued Jan. 25, 2000 to Herman is hereby incorporated by reference. U.S. Pat. No. 6,019,717 which issued Feb. 1, 2000 to Herman is hereby incorporated by reference.

A majority of the overall packaging and construction for centrifuge 20 is the same as that disclosed in the two referenced United States patents. The noted difference is the replacement of the prior art cone-stack subassembly by the spiral vane module 21 of the present invention. Other minor structural changes are included in order to accommodate the spiral vane module 21 as illustrated in the partial side-by-side comparison in FIG. 6.

Centrifuge 20 operates in a manner very similar to that described in the '912 and '217 patents in that it receives an incoming flow of liquid, typically oil, through an inlet opening in a corresponding supporting base (not illustrated). A connecting passage in that base allows the liquid to flow into the hollow interior of the rotor hub which may also be described as a bearing tube 22. The liquid then flows upwardly until reaching the top tube apertures 23. There are typically four apertures 23 which are equally spaced around the upper circumferential surface of tube 22. The liquid exits through these apertures 23 and flows radially outwardly as it enters the vicinity of the spiral vane module 21. The upper portion of the liner 24 is configured with integrally molded acceleration vanes 25 which cooperate to define flow channels (one channel between each adjacent pair of acceleration vanes). These acceleration vanes, typically four, six, or eight on equal spacing, facilitate the radially outward flow of the oil (or other liquid) and deliver the liquid flow to the location of inlet holes 26 which are molded into top plate 27 of the spiral vane module 21. The liner 24 is encased by shell 28 which is assembled to base 29. The liquid enters the inlet holes 26 and flows through the spiral vane module 21 ultimately exiting at the lower edge 31 of module 21. At this point, the flow passes through the annular clearance space 32 between the supporting base plate 33 and the outer surface of the bearing tube 22 or rotor hub. The exiting flow continues on to the two flow jet orifices 34 (only one being visible in the section view). These two flow jet orifices represent the interior openings for two tangentially directed jet flow nozzles. The high velocity jet which exits from each nozzle orifice generates a reaction torque which in turn drives (rotates) the centrifuge 20 at a sufficiently high rate of between 3000 and 6000 rpm in order to achieve particle separation within the spiral vane module concurrently with the flow of the liquid through the spiral vane module 21. The liquid flow through centrifuge 20, including the specific flow path and the use of the exiting liquid for self-driving of centrifuge 20, is basically the same as what is disclosed in U.S. Pat. Nos. 5,575,912; 5,637,217; 6,017,300; and 6,019, 717 with the important exception of what occurs within the spiral vane module 21 and with the important exception of the construction of module 21 which is strikingly different from the cone-stack subassembly construction as depicted in the '912 and '217 patents.

With continued reference to FIGS. 1 and 2, the spiral vane module 21 is positioned within the liner 24 in basically the same location occupied by the prior art cone-stack subassembly. The module 21 includes top plate 27 and a series of identically configured and equally-spaced (see gap 37) spiral vanes 38. The concept of "equally-spaced" refers only to a uniform pattern from spiral vane to spiral vane and not through the space or gap defined by adjacent vanes moving in an outward radial direction. The space or gap 37 between adjacent vanes 38 gradually becomes larger (i.e., circumferentially wider) when moving radially outward from the location of the inner hub portion 39 to the outermost edge 40.

The entire spiral vane module 21 is molded out of plastic as a unitary, single-piece component. The individual vanes 38 are joined along their inner edge into a form of center tube or hub portion 39 which is designed to slide over the bearing tube or what is also called the centrifuge rotor hub 22. By properly sizing the inside diameter 41 of the hub portion 39 relative to the outside diameter of the rotor hub, it is possible to create a closely toleranced and concentric fit. This in turn contributes to the overall balance which is desired due to the rate at which the centrifuge rotates.

The spiral vane module 21 is annular in form with the individual spiral vanes 38 (34 total) being arranged so as to create a generally cylindrical form. The molded hub portion 39 is cylindrical as well. The top plate 27 is generally conical in form, though it does include a substantially flat annular ring portion 27*a* surrounding the hollow interior 42. It is also envisioned that this top plate 27 geometry could have a hemispherical upper surface. Also included as part of module 21 and located adjacent to outer peripheral edge 43 of the top plate 27 is a divider shield 44. Divider shield 44 also has an annular ring shape and extends in a horizontal direction radially outwardly. The plurality of inlet holes 26 molded into top plate 27 are located adjacent the outer peripheral edge 43 of the top plate which is also adjacent and close to where shield 44 begins. In the section view of FIG. 2, the inlet holes 26 and shield 44 are shown in broken line form since they are actually above the cutting plane 2—2. The broken line form is used to diagrammatically illustrate where these features are located relative to the vanes 38.

The flow of liquid exiting the tube apertures 23 and from there being routed in the direction of the inlet holes 26 is actually "dropped off" by the acceleration vanes 25 at a location (radially) corresponding to the inlet holes 26. The flow passes through the top plate 27 by way of these inlet holes wherein there is one hole corresponding to each separation gap 37 between each pair of adjacent spiral vanes 38. As the flow passes through the inlet holes and into each gap 37, it flows through the gaps in a radially inward and axially downward direction due to the location of the flow exit between the outer surface of the rotor hub and the inner edge of the base plate. The flow dynamics are such that the flow exiting from the tube apertures 23 tends to be evenly distributed across the surface of the top plate and thus equally distributed through the thirty-four inlet holes 26. As described, there is one inlet hole corresponding to each gap and one gap corresponding to each vane 38. As the flow of liquid travels through each gap 37 from the outer and wider point to the inner and more narrow point adjacent the rotor hub, the centrifugal force due to the high rate of rotation of the centrifuge acts upon the heavier particulate matter, allowing it to gradually migrate in a radially outward direction, collecting on the concave surface of the spiral vane and continues to slip outward, where it ultimately exits from the module and accumulates in a sludge collection zone located between the outer periphery of the module 21 and the inner surface of liner shell 24. One possible particulate path for particle 45 is diagrammatically illustrated in FIG. 5.

The divider shield 44 extends in an outward radial direction from the approximate location of the inlet holes 26 to a location near, but not touching, the inside surface 48 of the liner 24. The divider shield 44 prevents flow from bypassing around the inlet holes 26 and thereby disturbing the quiescent zone 50 where sludge (i.e., the separated particulate matter and some oil) is being collected. By preventing the flow from disturbing the quiescent zone 50, the design of the present invention also prevents to a great extent the re-entrainment of particulate matter which has already been separated from the flowing liquid. The concept of re-entrainment involves loosening or picking up some of the particulate matter already separated from the liquid flow and allowing it to go back into the liquid, thereby undoing the work which had already been done. It is also to be noted that the distance of separation between the divider shield 44 and the inside surface 48 of liner 24 is large enough to permit larger particulate matter that might be separated in the region of the acceleration vanes 25 to be discharged into the quiescent zone 50.

As the flow of liquid passes through the inlet holes 26 and into the separation gaps 37, it spreads out within the gaps and proceeds inward radially and axially downward toward the lower edge 31 where the flow exits by way of clearance space 32. The flow is prevented from bypassing the designed flow through gaps 37 by the use of base plate 33 which closes off any other exit path for the flow except for the flow opening provided by the clearance space 32 which is defined by the inner circular edge 51 of the base plate 33 and the outer surface 52 of bearing tube 22 or what has been called the rotor hub (see FIG. 1A).

In an alternative embodiment of the present invention (see FIG. 1B), the base plate 33*a* extends into contact with bearing tube 22 such that clearance space 32 is closed. In order to provide a flow path, a plurality of clearance holes 33*b* are created in base plate 33*a* at approximately the same location of clearance space 32. The individual vanes 38 have been omitted from the section views of FIGS. 1A and 1B for drawing simplicity. In lieu of circular holes 33*b*, virtually any type of opening can be used, including radial and/or circumferential slots.

Figure 3:
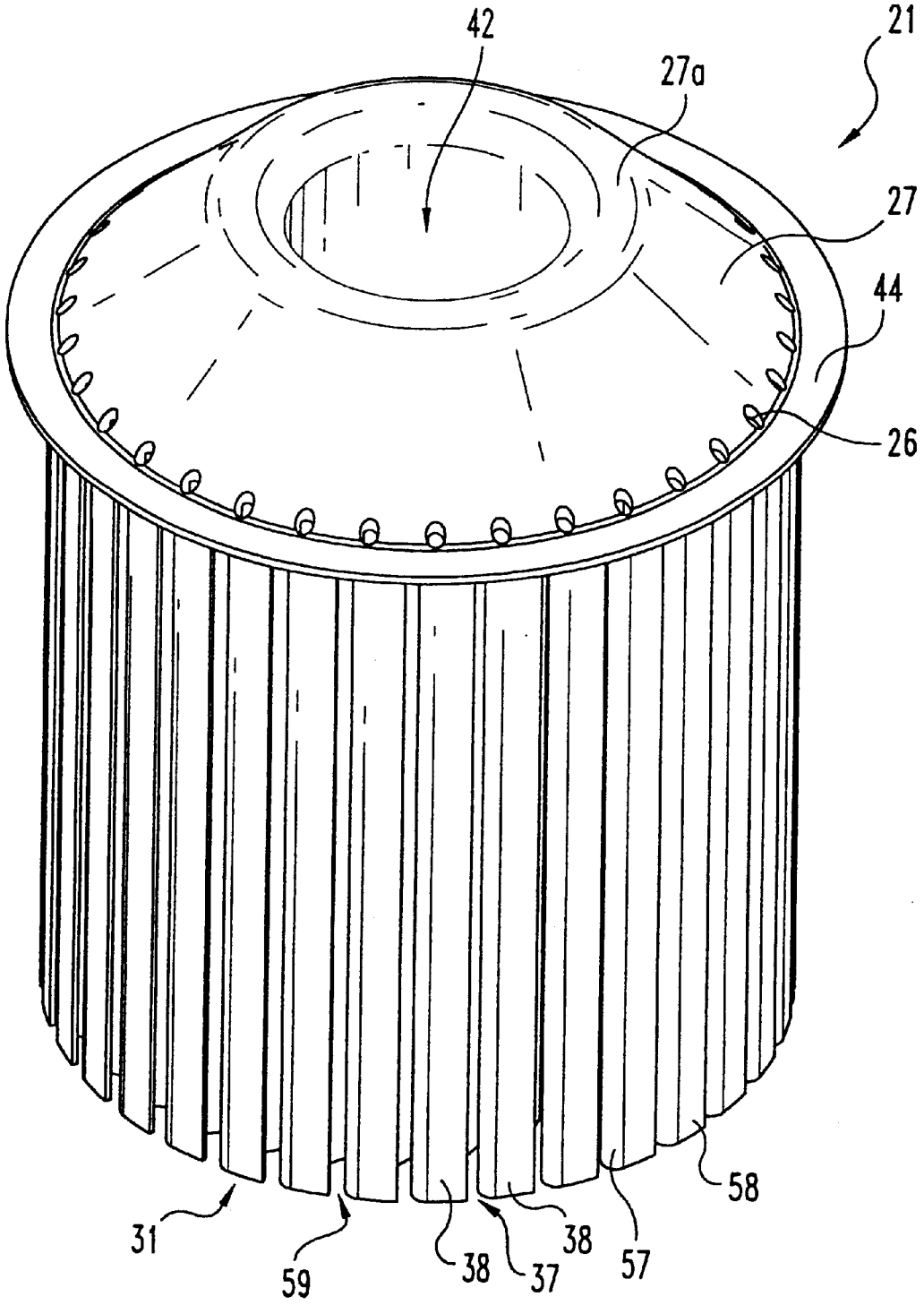
FIG. 3 is a top perspective view of a molded spiral vane module which comprises one portion of the FIG. 1 centrifuge according to the present invention.
Figure 4:
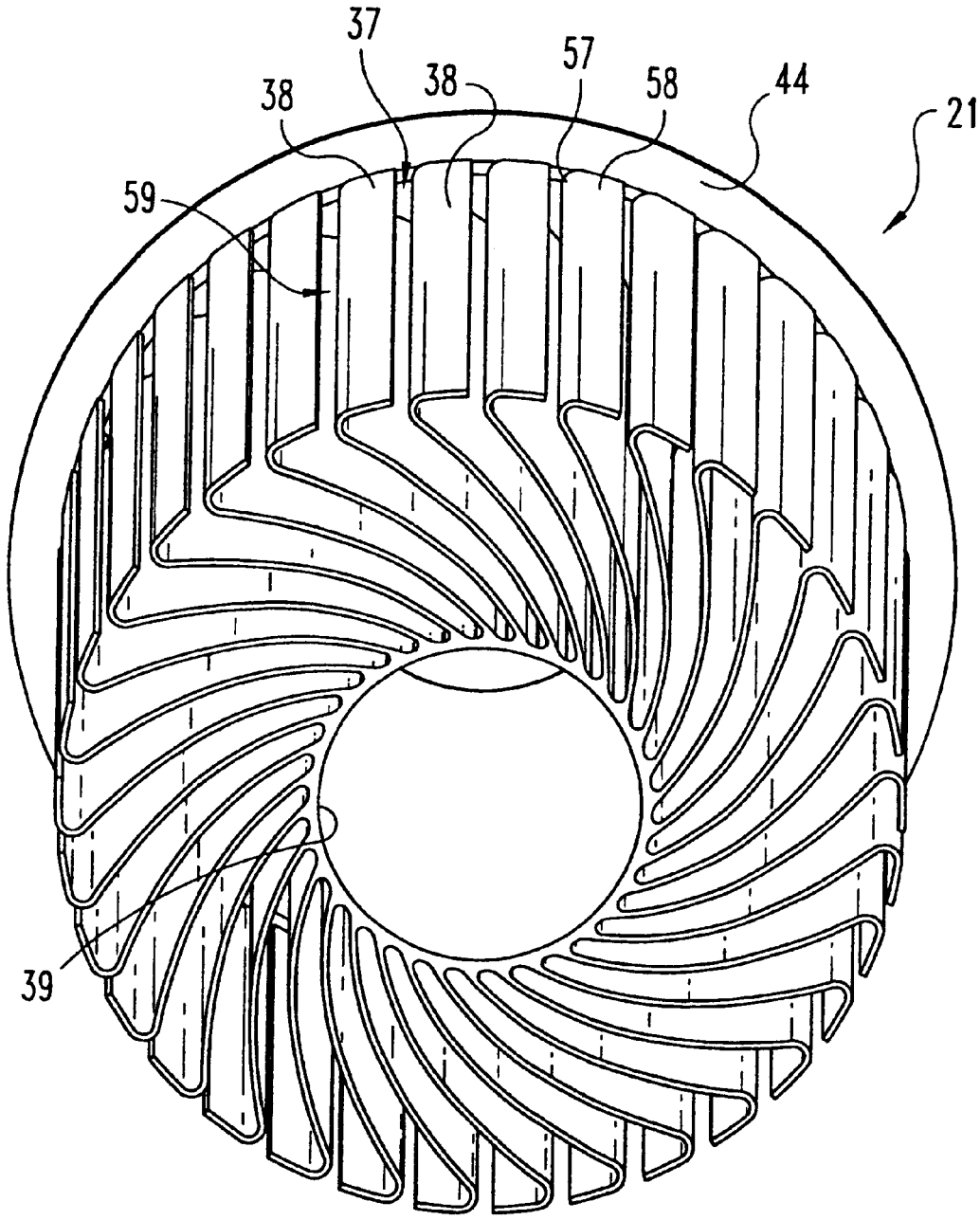
FIG. 4 is a bottom perspective view of the FIG. 3 spiral vane module.
Figure 5:
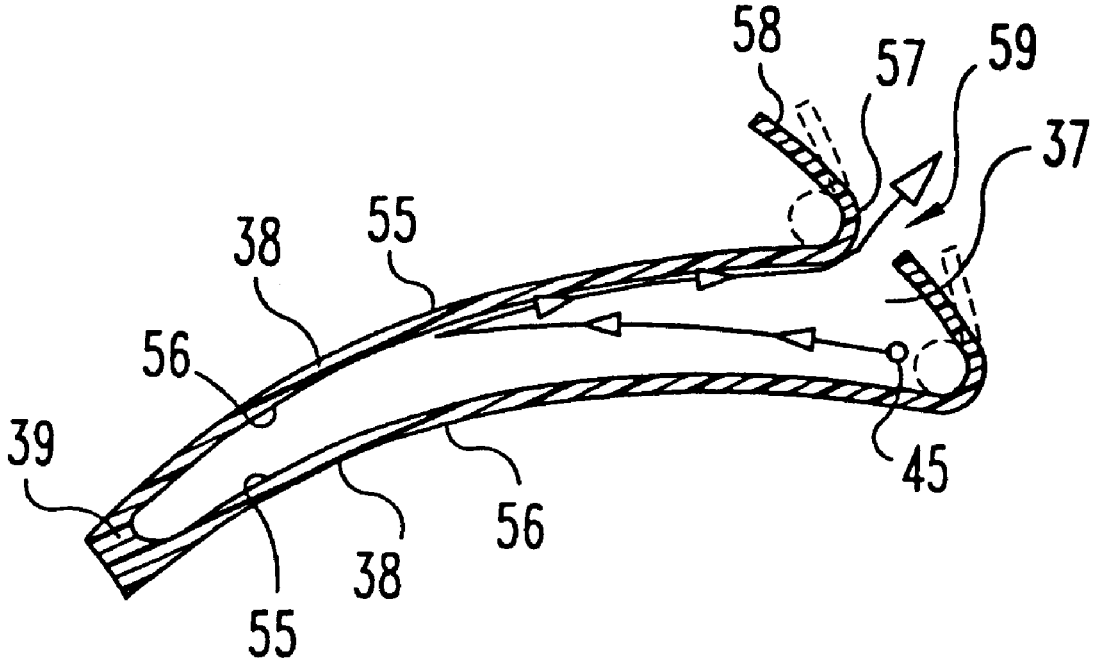
FIG. 5 is a partial, top plan, diagrammatic view of two spiral vanes of the FIG. 3 spiral vane module and the corresponding particle path.

With reference to FIGS. 3, 4, and 5, the structural details of the spiral vane module 21 are illustrated. FIGS. 3 and 4 are perspective views of the molded unitary design for module 21. FIG. 5 shows in a top plan view orientation and in diagrammatic form a pair of spiral vanes 38 and the gap 37 which is positioned therebetween. As partially described in the context of the flow path, the spiral vane module 21 includes thirty-four spiral vanes 38, each of which are of virtually identical construction and are integrally joined into a unitary, molded module. Each of these thirty-four spiral vanes 38 are integrally joined as part of the unitary construction along their uppermost edge to the underside or undersurface of top plate 27. Each spiral vane 38 extends away from the top plate in an axial direction toward its corresponding lower edge 31. The inner edge of each vane is cooperatively formed into the inner hub portion 39. Each spiral vane 38 includes a convex outer surface 55 and a concave inner surface 56. These surfaces define a spiral vane of substantially uniform thickness which measures approximately 1.0 mm (0.04 inches). The convex surface 55 of one vane in cooperation with the concave surface 56 of the adjacent vane defines the corresponding gap 37 between these two vanes. The width of the gap between vanes or its circumferential thickness increases as the vanes extend outwardly.

As each spiral vane 38 extends in a radial direction outwardly away from inner hub portion 39, it curves (curved portion 57) so as to partially encircle the corresponding inlet hole 26. As portion 57 extends tangentially away from the inlet hole location, it forms a turbulence shield 58. The turbulence shield 58 of one spiral vane 38 extends circumferentially in a counterclockwise direction based upon a top plan view toward the adjacent vane. There is a separation gap 59 defined between the free end or edge of one shield 58 on one vane and the curved portion 57 on the adjacent spiral vane. This separation gap is actually an axial or full length slit and measures approximately 1.8 mm (0.07 inches) in width in a circumferential direction. The slight curvature in each turbulence shield 58 in cooperation with the alternating separation gaps 59 creates a generally cylindrical form which defines the outermost surface of the spiral vane module 21 which is positioned beneath the top plate 27.

The curvature of each spiral vane from its inner edge to its outer curved portion has a unique geometry. A line 60 drawn from the axial centerline 60*a* of centrifuge rotation to a point of intersection 61 on any one of the thirty-four spiral vanes 38 forms a 45 degree included angle 60*b* with a tangent line 62 to the spiral vane curvature at the point of intersection (FIG. 2). This unique geometry applies to the convex and concave portions of the main body of each spiral vane and does not include either the curved portion 57 or the turbulence shield 58. The included angle, which in the preferred embodiment is 45 degrees, can be described as the spiral vane angle for the spiral vane module and for the corresponding centrifuge. It is envisioned that the preferred range for the included angle will be from 30 to 60 degrees. Where the earlier referenced '912 and '217 patents defined a cone angle, typically 45 degrees based on the slope or incline of the conical wall of each cone, the present invention defines a spiral vane angle.

In the process of the flow passing through gaps 37, the particulate matter to be separated drifts across the gap in an outward, generally radial path through the gap between adjacent vanes 38 due to a radial centrifugal force component. This particulate matter actually drifts upstream relative to the direction of flow in a manner similar to what occurs with the aforementioned cone-stack subassembly designs of the '912 and '217 patents. Once the particles comprising the particulate matter to be separated from the liquid flow reach the concave inward spiral surface of the corresponding vane (see FIG. 5), they migrate radially outward in the absence of flow velocity due to the fluid boundary layer. This radially outward path is in the direction of the sludge collection or quiescent zone 50. The particles then "fall out" of the spiral vane module through the continuous axial slits which are located between the circumferentially discontinuous turbulence shields of the corresponding spiral vanes (i.e., separation gaps 59). As described, the function of the turbulence shields is to reduce fluid interaction between the flow occurring in the gaps 37 and the sludge collection zone (quiescent zone 50). While this sludge collection zone is referred to as a "quiescent zone", that choice of terminology represents the preferred or desired condition. Ideally this sludge collection zone 50 would be completely quiescent so that there would be virtually no turbulence and no risk of any particulate matter being re-entrained back into the liquid flow. The turbulence shields 50, as viewed in a top plan orientation, presently are arranged so as to create or define a circular profile. However, it is contemplated that within the scope of the present invention, each of these turbulence shields 58 could be tilted outward slightly in order to allow particulate matter that may collect on the inner surface of each turbulence shield to also "slip out" into the collection zone. Since there is effectively a corner created at the location of the curved portion for each spiral vane, there could be a tendency for some particulate matter to accumulate in that corner. By tilting the turbulence shield portion, this corner is opened so that there is a greater tendency for any trapped particulate matter to be able to slide out into the sludge collection zone (quiescent zone 50). This alternative shape for the turbulence shield portion is illustrated by the broken line form in FIG. 5.

After the flow leaves the gaps between the adjacent spiral vanes and exits the clearance space adjacent the rotor hub, it passes to the jet nozzles where it is discharged at high velocity, causing the rotor to rotate at high speed due to the reaction force. As an alternative to this configuration, the specific rotor could be driven by a rotor-mounted impulse turbine. Additionally, the molded spiral vane module is "encapsulated" inside a sludge-containing liner shell/base plate assembly similar to that disclosed in U.S. Pat. No. 5,637,217. This particular configuration allows the quick the easy servicing of the centrifuge rotor since the sludge is contained entirely within the inner capsule and no scraping or cleaning is necessary. Alternatively, the spiral vane module of the present invention could replace a cone-stack subassembly included as part of a fully disposable centrifuge rotor design.

Figure 6:
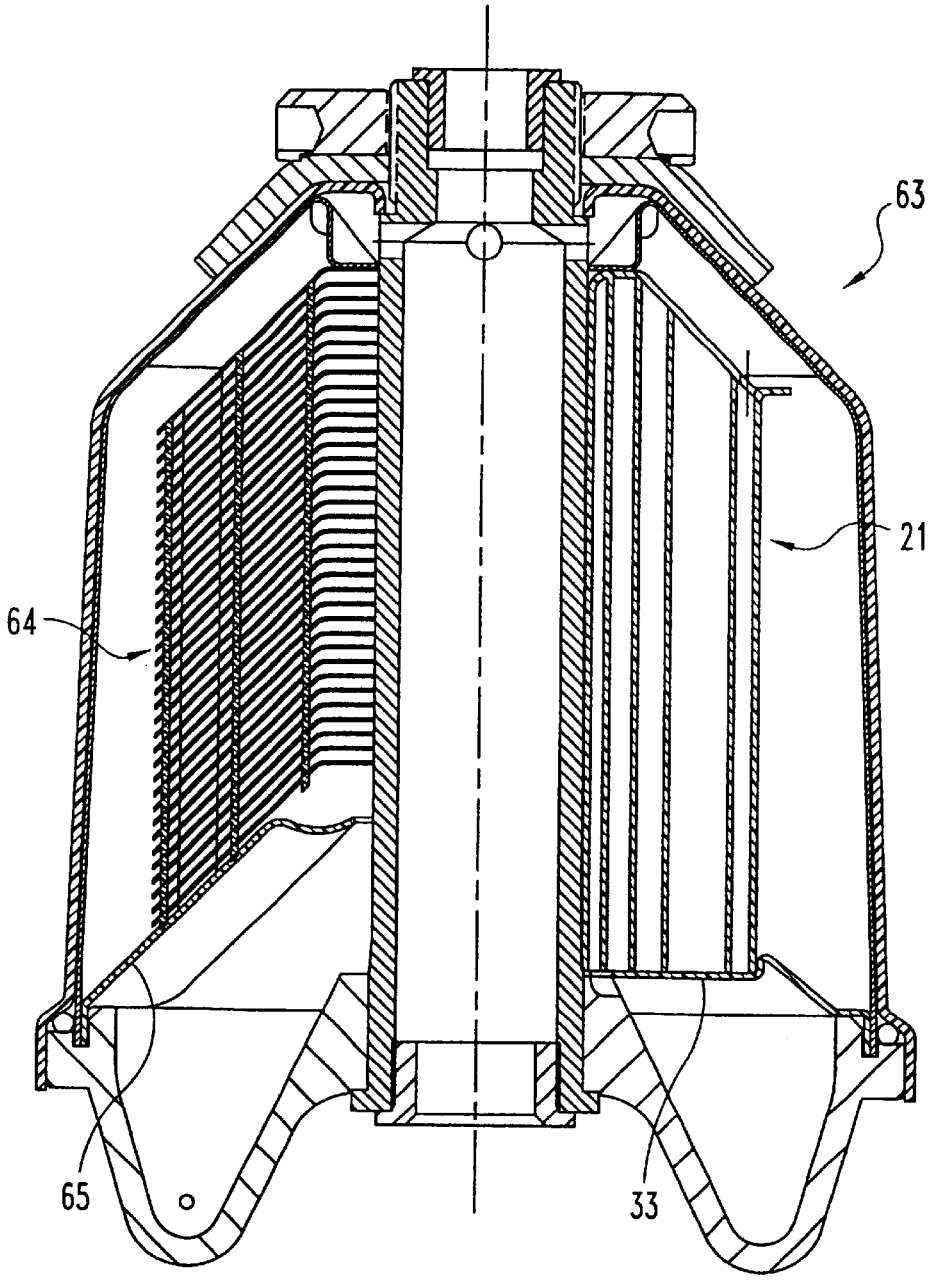
FIG. 6 is a diagrammatic, front elevational view, in full section showing a side-by-side comparison of a prior art cone-stack subassembly compared to the FIG. 3 spiral vane module according to the present invention.

Referring to FIG. 6, a diagrammatic side-by-side illustration is provided which shows on the left side of the centrifuge 63 one-half of a typical prior art cone-stack subassembly 64 and on the right side one-half of spiral vane module 21 according to the present invention. The FIG. 6 illustration is intended to reinforce the previous description which indicated that the spiral vane module 21 of the present invention is or can be a substitution for the prior art cone-stack assembly as depicted in U.S. Pat. Nos. 5,575,912; 5,637,217; 6,017,300; and 6,019,717. While the design of the corresponding base plates 65 and 33 changes slightly between the two styles, the balance of the centrifuge construction is virtually identical for each style.

Figure 7A:
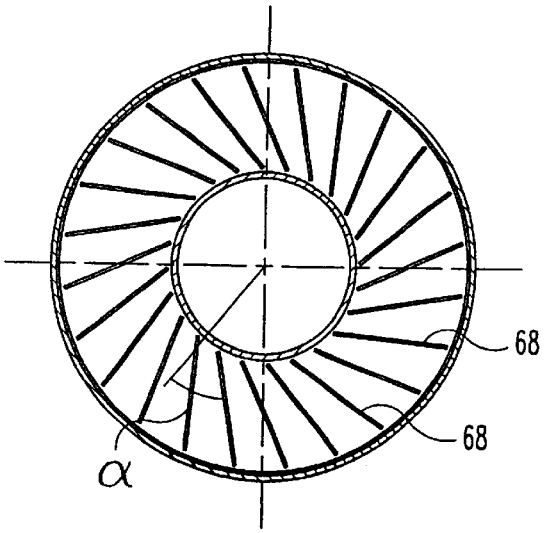
FIG. 7A is a diagrammatic, top plan view of an alternative vane style according to the present invention.
Figure 7B:
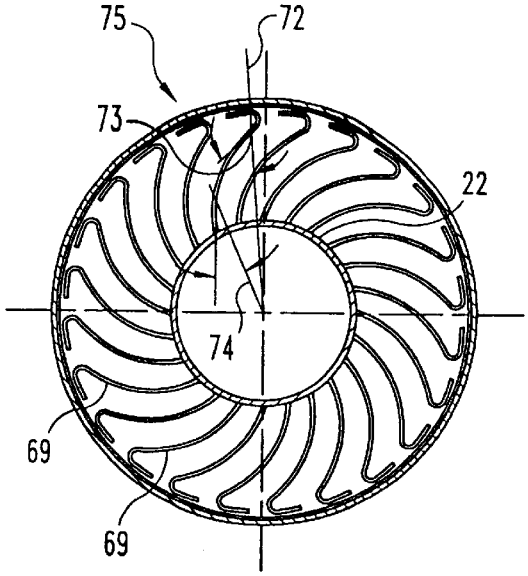
FIG. 7B is a diagrammatic, top plan view of yet another alternative vane style according to the present invention.
Figure 7C:
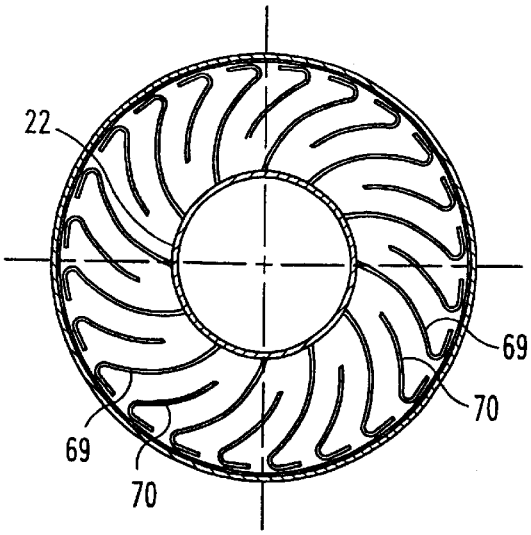
FIG. 7C is a diagrammatic, top plan view of a further alternative vane style according to the present invention.

Referring to FIGS. 7A, 7B, and 7C, three alternative design embodiments for the style of spiral vanes to be used as part of the spiral vane module are illustrated. While still keeping within the same context of the theory and functioning of the present invention and while still maintaining the concept of replacing the prior art cone-stack subassembly with a spiral vane module, any one of these alternative designs can be utilized.

In FIG. 7A, the curved spiral vanes 38 of module 21 are replaced with vanes 68 having substantially flat, planar surfaces. The vanes 68 are offset so as to extend outwardly, but not in a pure radial manner. The top plan view of FIG. 7A shows a total of twenty-four vanes or linear plates 68, but the actual number can be increased or decreased depending on such variables as the overall size of the centrifuge, the viscosity of the liquid, and the desired efficiency as to particle size to be separated. The pitch angle ($\alpha$) or incline of each plate is another variable. While each plate 68 is set at the same radial angle ($\alpha$), the selected angle can vary. The choice for the angle depends in part on the speed of rotation of the centrifuge.

In FIG. 7B, the individual vanes 69 are curved, similar to the style of vanes 38, but with a greater degree of curvature, i.e., more concavity. Further, each individual vane 69 has a gradually increasing curvature as it extends away from bearing tube 22. This vane shape is described as a "hyper-spiral" and is geometrically defined in the following manner. First, using a radial line 72 drawn from the axial centerline of bearing tube 22 which is also the axial centerline of module 21, have this line intersect a point 73 on the convex surface of one vane. Drawing a tangent line 74 to this point of intersection 73 defines an included angle 75 between the radial line and the tangent line. The size of this included angle 75 increases as the point of intersection 73 moves farther away from bearing tube 22. The theory with this alternative spiral vane embodiment is to shape each vane so that there is a constant particle slip rate as the g-force increases proportionally with the distance from the axis of rotation. With the exception of the curvature geometry for each vane 69, the spiral vane module diagrammatically illustrated in FIG. 7B is identical to spiral vane module 21.

In FIG. 7C, the spiral vane design for the corresponding module is based on the vane 69 design of FIG. 7B with the addition of partial splitter vane 70. There is one splitter vane 70 between each pair of full vanes 69 and the size, shape, and location of each one is the same throughout the entire module. The splitter vanes 70 are similar to those used in a turbocharger compressor in order to increase the total vane surface area whenever the number of vanes and vane spacing may be limited by the close spacing at the hub inside diameter.

Other design variations or considerations for the present invention include variations for the manufacturing and molding methods. For example, the generally cylindrical form of the molded vanes (or plates) can be extruded as a continuous member and then cut off at the desired axial length or height and assembled to a separately manufactured, typically molded, top plate. The top plate is molded with the desired inlet holes and divider shields as previously described as part of module 21.

Another design variation which is contemplated for the present invention is to split the spiral vane module into two parts, a top half and a cooperating bottom half. This manufacturing technique would be used to avoid molding difficulties that may arise from close vane-to-vane spacing. After fabrication of the two halves, they are joined together into an integral module. In this approach, it is envisioned that the top plate will be molded in a unitary manner with the top half of the vane subassembly and that the base plate will be molded in a unitary manner with the bottom half of the vane subassembly.

Figure 8:
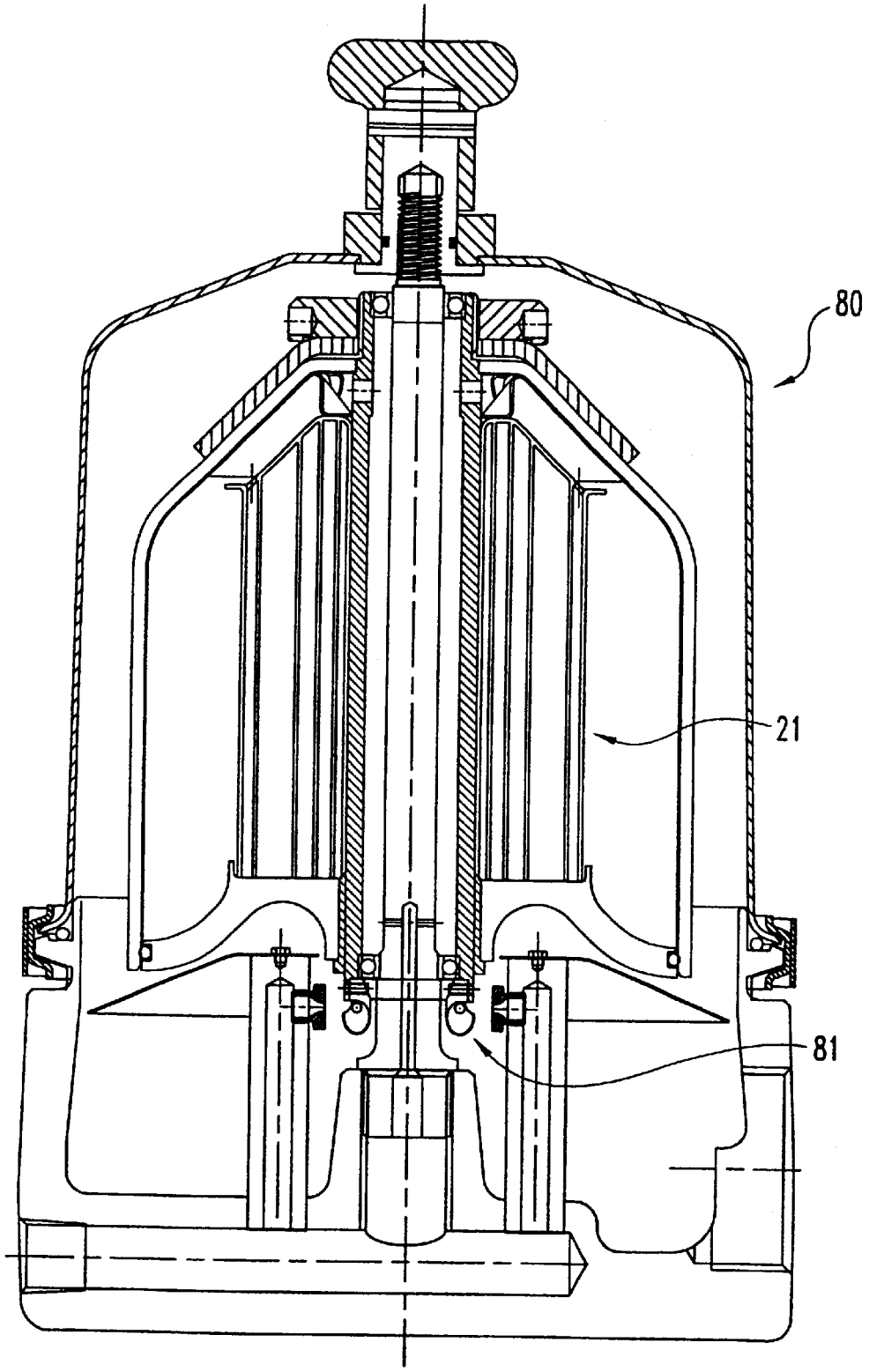
FIG. 8 is a front elevational view in full section of an impulse-turbine driven centrifuge according to another embodiment of the present invention.
Figure 8A:
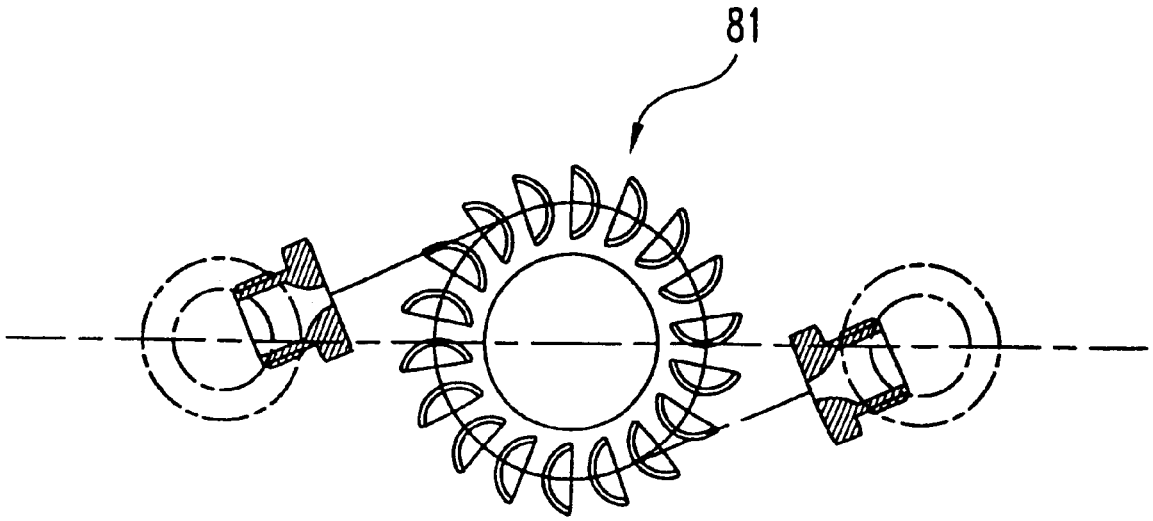
FIG. 8A is a diagrammatic top plan view of the impulse-turbine arrangement associated with the FIG. 8 centrifuge.

The spiral vane module 21 and/or any of the three alternative (spiral) vane styles of FIGS. 7A, 7B, and 7C can be used in combination with an impulse-turbine driven style of centrifuge 80 as illustrated in FIGS. 8 and 8A. For this illustration, spiral vane module 21 has been used. The impulse-turbine arrangement 81 is diagrammatically illustrated in FIG. 8A.

Figure 9:
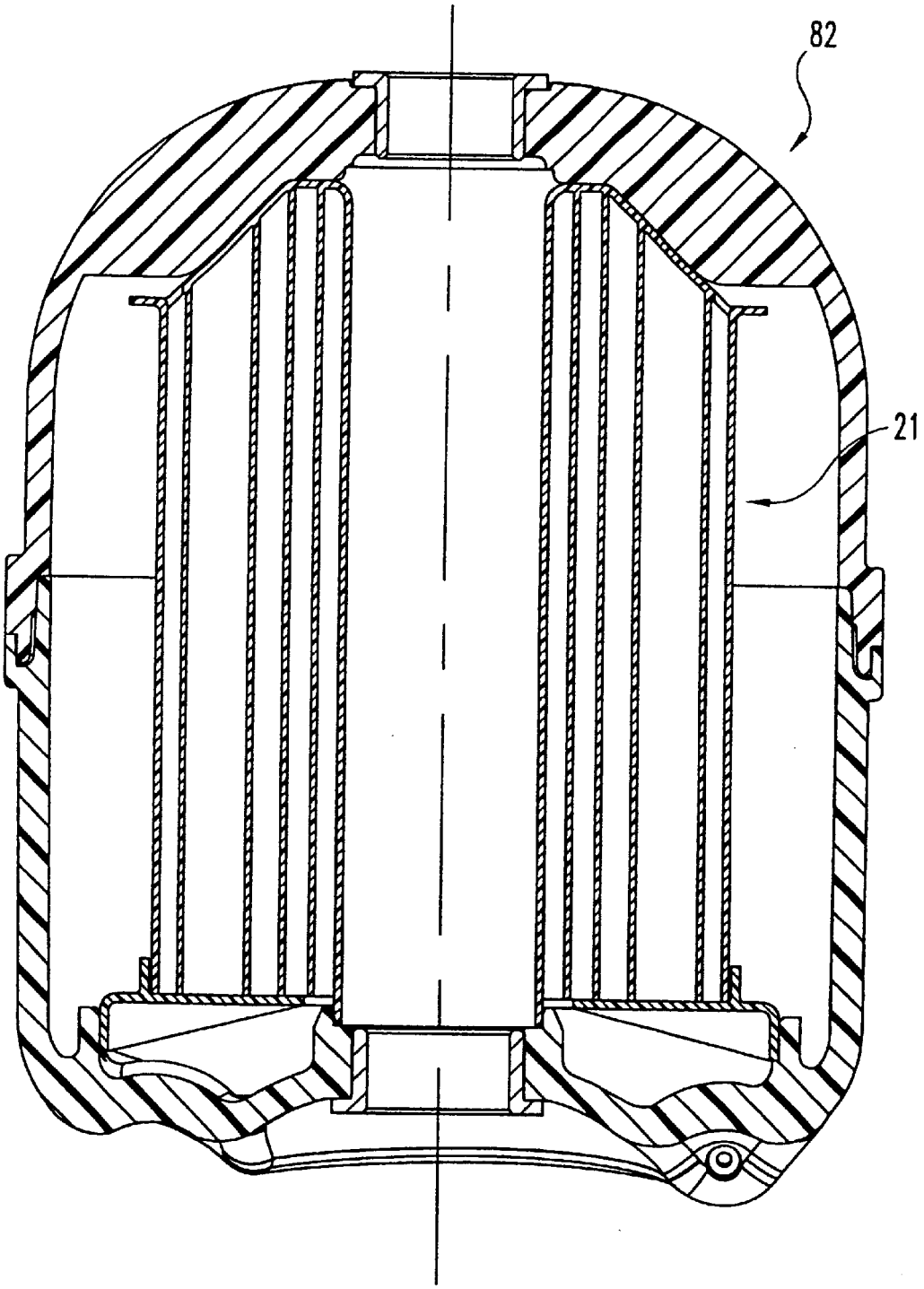
FIG. 9 is a front elevational view in full section of a disposable rotor according to another embodiment of the present invention.

It is also envisioned that spiral vane module 21 and/or any of the three alternative (spiral) vane styles of FIGS. 7A, 7B, and 7C can be used as part of a disposable rotor 82 which is suitable for use with a cooperating centrifuge (not illustrated). Spiral vane module 21 has been included in the FIG. 9 illustration. It is also envisioned that the disposable rotor 82 of FIG. 9 can be used in combination with an impulse-turbine driven style of centrifuge, such as centrifuge 80.

Figure 10:
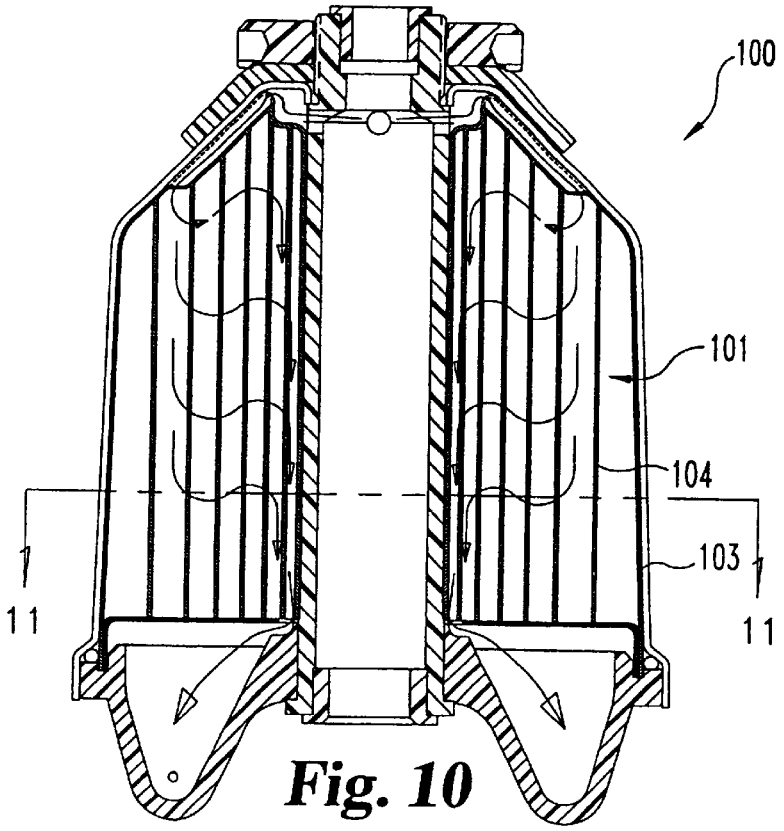
FIG. 10 is a front elevational view in full section of a centrifuge rotor assembly according to another embodiment of the present invention.
Figure 11:
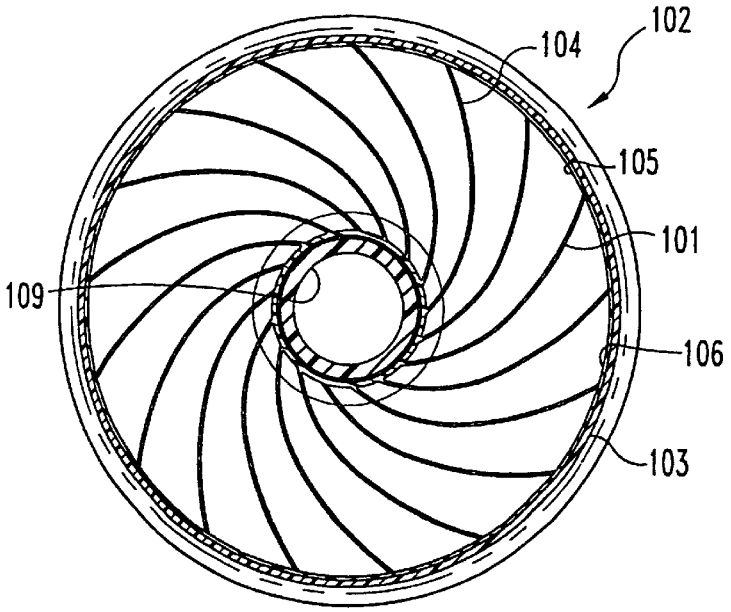
FIG. 11 is a top plan view in full section of a full vane module comprising one component of the FIG. 10 centrifuge rotor assembly, as viewed along line 11—11 in FIG. 10.
Figure 12:
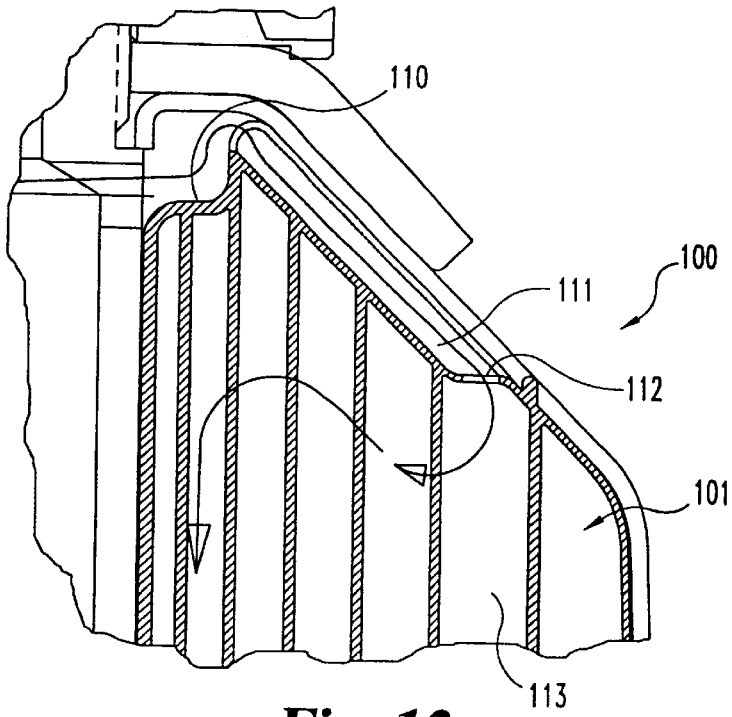
FIG. 12 is a partial, enlarged detail of one portion of the FIG. 10 centrifuge rotor assembly.

Referring to FIGS. 10, 11, and 12, another embodiment of the present invention is illustrated. FIG. 10 details, in a full sectional view, a centrifuge rotor assembly 100 wherein the spiral vane module 101 is molded as a unitary component 102 with the liner shell 103. As such, the individual spiral vanes 104 extend radially, albeit with the illustrated curvature, to a point of contact 105 with the inner surface 106 of the liner shell 103 (see FIG. 11). As such, this embodiment is best described as a "full vane" design, due to the radial extent of each vane and the fact that the outer tips of each vane contact and in fact are integral with the inner surface of the liner shell. In a related embodiment, the outer edges of the individual vanes are in very close proximity to the inner surface of the liner shell without any measurable separation between the vanes and the liner shell, but the liner shell is still a separate component.

The unitary, molded plastic configuration for component 102 is designed as a replacement for the cone-stack, base plate and liner shell components of earlier designs. As a general review of these earlier designs, they typically include a cone-stack subassembly using a stack of between 20 and 50 individual cones which need to be separately molded, stacked, and aligned before final assembly with the liner shell and base plate. In the case of a disposable rotor design, the assembly of the individual cones would be on to a central hub with an upper alignment spool maintaining final positioning. This type of design results in a higher tooling cost due to the large multi-cavity molds which are required. There is also a higher assembly cost due to the time required to individually stack and align the various cones. While earlier embodiments of the present invention have focused on various vane designs as replacements for such cone-stack subassemblies, the embodiment of FIGS. 10, 11, and 12 provides further improvements. Due to the "full vane" feature of this embodiment, there is a reduction or substantial elimination of any tangential fluid slippage rotation in the sludge zone adjacent the inner surface of the liner shell or alternatively the rotor shell. As a result, the full vane design for spiral vane module 101 provides improved separation efficiency while still maintaining the desirable lower cost.

With continued reference to FIG. 11, in the disclosed embodiment of this unitary component 102 (i.e., spiral vane/liner module), the spiral vanes 104 are molded between the center tube portion 109 and the inside surface 106 of the liner shell 103. As such, each of the spiral vanes of spiral vane module 101 span the entire radius of the rotor assembly which can also be referred to as the sludge collection vessel. The center tube portion 109 slides over the rotor hub, forming a close fit in order to prevent flow from bypassing the spiral vanes between the rotor hub and the center tube portion. The liner shell 103 nests inside the structural rotor shell. The top, inside diameter portion of the liner shell 103 has a small "step" 110 which drops down below the level of the inlet holes near the top of the rotor hub. The annular zone created by this step connects with numerous indented radial/spiral channels 111 molded into the top outside surface of the liner shell, there being one channel molded between the gaps of each pair of spiral vanes. At the end of the indented channel, a small hole 112 through the liner shell 103 allows fluid to pass into the spiral vane module passages 113.

Since the oil passing radially outward through these flow channels has not been "cleaned" as of this point in the process, it may be prove to be advantageous to incorporate ridge-like seals around the edge of each channel, or at least a ring around the outer termination diameter of the channels in order to reduce the deposition of sludge between the liner shell and rotor shell. It is desirable to limit the deposition of sludge between the liner and rotor since that sludge causes the liner to stick in the rotor and makes service not only a messier process but a more difficult process.

It is also important to note that this particular embodiment eliminates the need for any additional top plate in order to accomplish the task of redirecting the fluid radially outward to the inlet zone of the spiral vane module 103. The embodiment which is illustrated in FIGS. 10–12 enables the vanes to be molded integrally with the liner shell in a single-part design which allows the fabrication expense to be lowered. Further, since the vanes are integral with the liner shell, it is not necessary to weld a base plate to the shell as there are no additional cones (or vane insert component) that need to be captured and held in position. Therefore, the base plate can be made a permanent component of the rotor itself. The base plate inside diameter is slightly larger than the hub outside diameter, providing an annular escape passage for the flow to exit the spiral vane module. Alternatively, the exit passage could be formed by discrete holes or slots positioned near the base plate inside diameter, with the base plate centering directly on the rotor hub outside diameter.

Figure 12A:
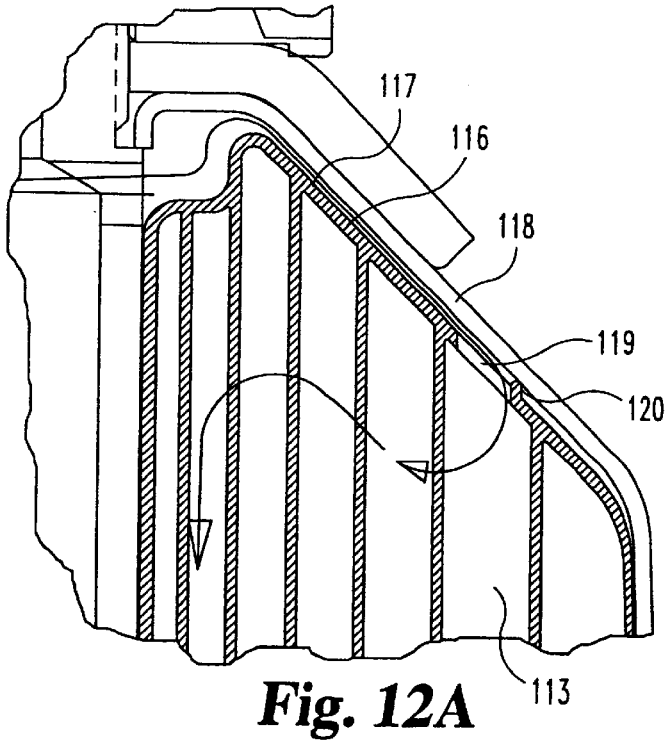
FIG. 12A is a partial, enlarged detail of one portion of an alternative embodiment to what is illustrated in FIG. 12.

An alternate arrangement (see FIG. 12A) to what is illustrated in FIG. 12 is to recess the entire upper surface 116 so that there is a clearance space 117 between upper surface 116 and the rotor shell 118. Thus, instead of having a plurality of separately defined clearance channels 111, there is a circumferential (annular) clearance space 117. In order to help direct the flow across upper surface 116 into hole(s) 119, an annular protruding ridge 120 is used in order to seal up against the inside surface of the rotor shell.

Figure 13:
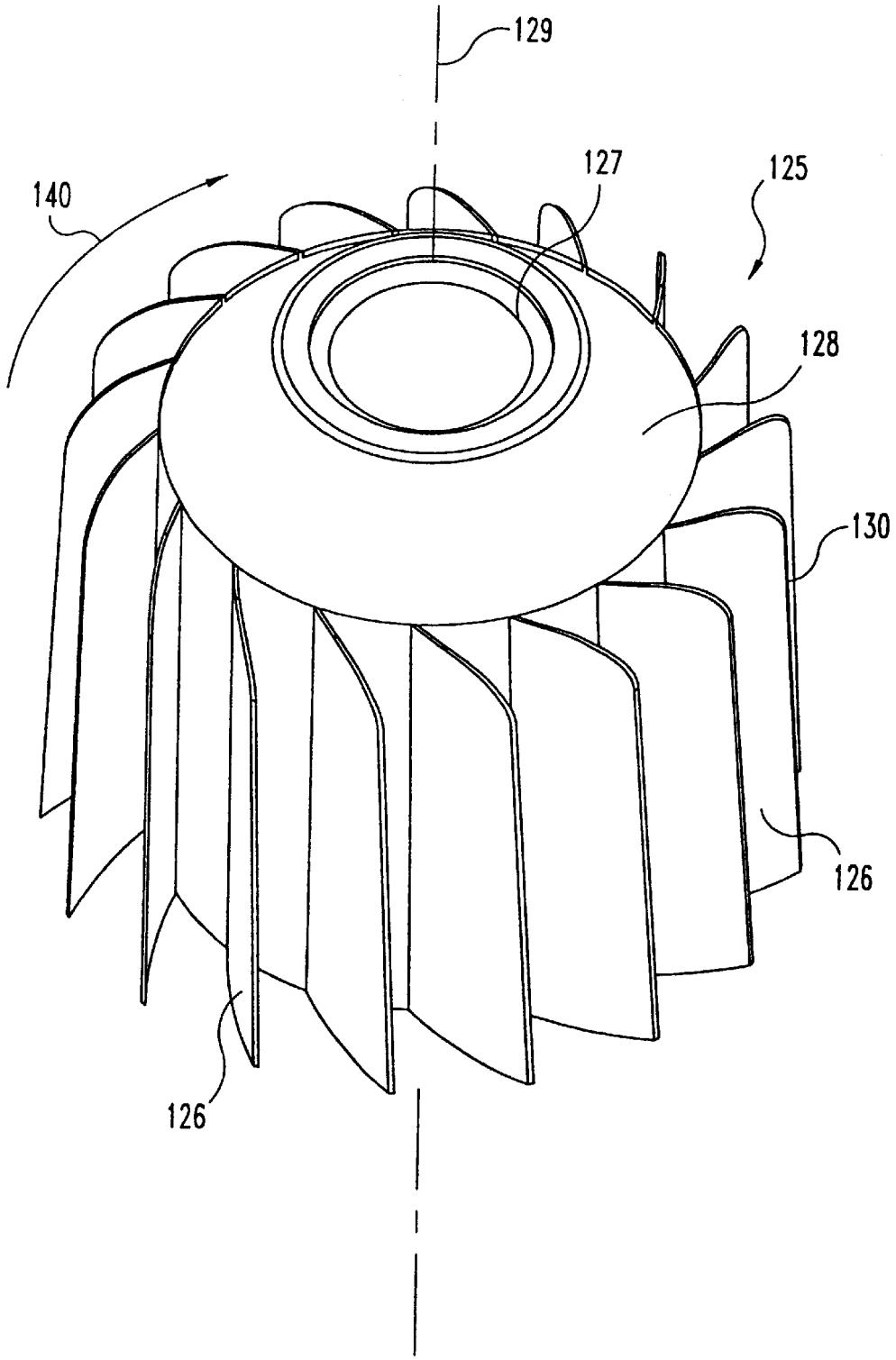
FIG. 13 is a top perspective view of a unitary vane module for use in another embodiment of the present invention.
Figure 14:
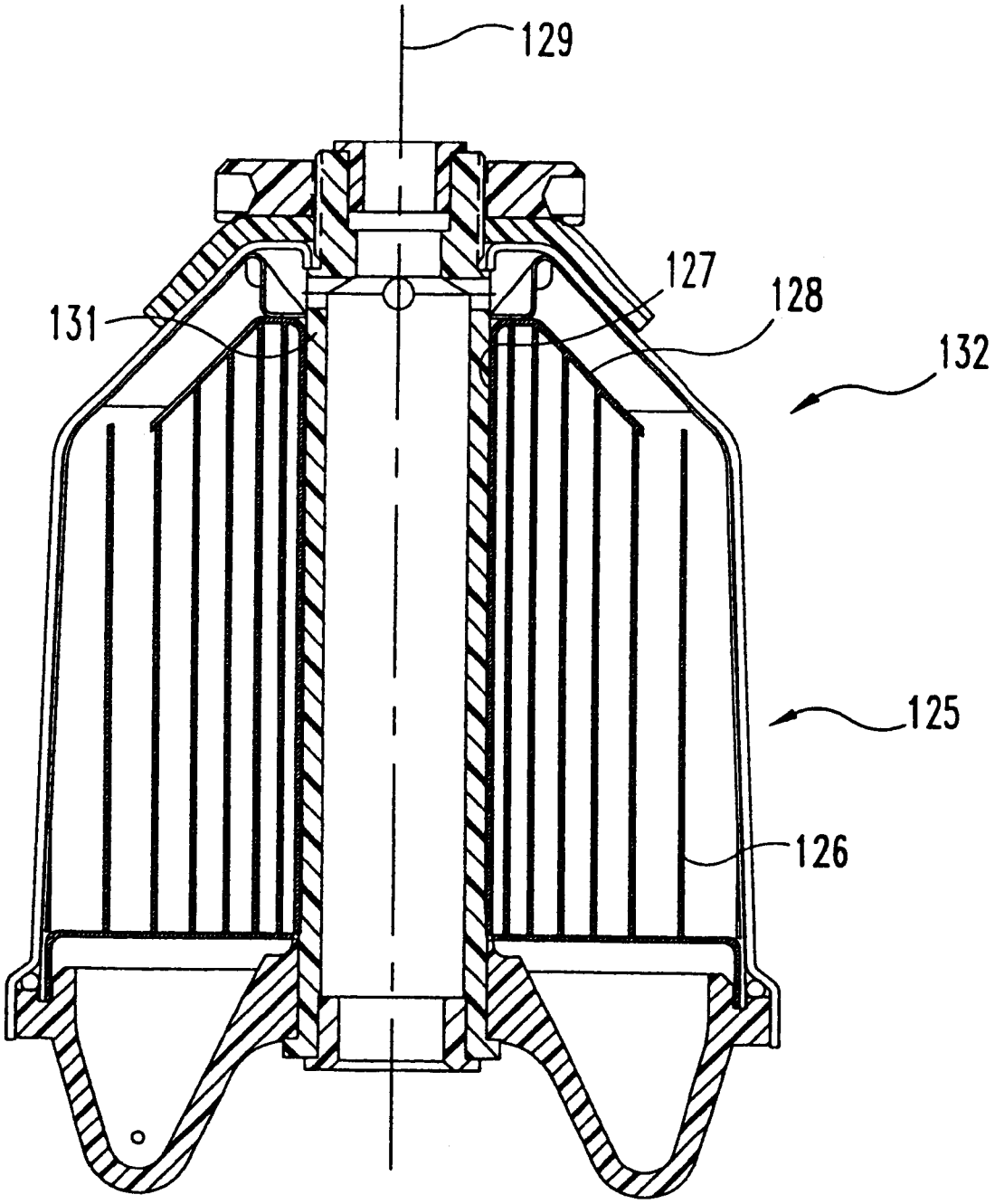
FIG. 14 is a front elevational view in full section of a centrifuge rotor assembly incorporating the FIG. 13 vane module.

In another embodiment of the present invention, see FIGS. 13 and 14, a separately molded vane module 125 is fabricated for assembly into a liner shell or alternatively into a rotor shell, if a liner shell is not used in the centrifuge rotor assembly. The unitary vane module 125 includes individual spiral vanes 126 which have a curvature geometry and radial extent virtually identical to spiral vane 104. These spiral vanes 126 are integral with center tube portion 127 and with top plate portion 128. Center tube portion 127, as with center tube portion 109, is constructed and arranged to slide over the rotor hub 131 of the rotor assembly 132 and forms a closely sized fit therewith in order to prevent flow from bypassing the spiral vanes between the rotor hub and center tube portion 127.

In the FIG. 13 embodiment, the integrally molded top plate portion 128 is positioned at the top or upper axial termination (edge) of the spiral vanes 126 in order to provide part of the flow re-directing function. With a separate liner shell, radial acceleration vanes are molded into the inside surface of the liner shell. The top plate portion 128 abuts up against these radial acceleration vanes (see FIG. 14), thereby creating multiple flow paths. When a liner shell is not used, the top plate portion 128 abuts up against inwardly-directed protrusions which are on or are part of the rotor shell.

With continued reference to FIGS. 13 and 14, it will be seen that the top plate portion 128 does not extend to the outer edges of the spiral vanes 126. The top plate portion 128 extends for approximately two-thirds of the overall dimension from the axial centerline 129 of the center tube portion 127 to the outer edge 130 of the spiral vanes 126 (i.e., the outside diameter of the vane module 125).

Even though the vane module 125 does not include an integral liner shell, the individual spiral vanes 126 are still designed as a "full vane" such that each one extends outwardly to a point which provides a line-to-line fit within the liner shell or at most a clearance of only a few mils. In a manner virtually identical to the vane portion of FIG. 11, the vanes 126 of module 125 sweep "away" from the direction of rotation of the rotor assembly (see arrow 140). The spiral angle of each vane 126 is equivalent to a 45 degree cone.

When the vanes are made (i.e., molded) integral with the liner shell (see FIG. 11), any rotational secondary "slippage" flow is eliminated. When the liner shell is a separate component, the closeness of the fit between the outer axial edges of the vanes and the inner surface of the liner shell becomes important. A small or zero clearance between these two surfaces is desired to minimize any rotational secondary slippage flow. Based on the descriptions already provided, this phrase should be understood as referring to the existence of any relative rotation of the fluid in the annular zone outboard of the vane edges.

The clearance space adjacent the inner surface of the liner shell has typically been free of any intruding objects, thus forming an annular sludge zone. With certain prior designs, whether using a cone-stack subassembly, or "non-full" vanes, there is a resulting increased clearance and, as such, this zone is able to be disturbed by unhindered tangential and axial motion of the fluid, even during steady state operating conditions. These secondary flows cause separated sludge and particulate to become re-entrained, resulting in reduced separation performance. In the disclosed embodiments detailing the full vane design, these fully extended vanes are able to actually lock the accompanying flow into axial channels. As a result, these full vane embodiments are able to substantially prevent any tangential motion of fluid relative to the rotor's rotation. Testing has confirmed that there are benefits to this full vane module design of reduced re-entrainment, thereby outperforming other designs which allow a greater clearance space between the outer edges of the cone-stack subassembly or non-full vane module and the inside surface of the liner shell or rotor shell.

Figure 15:
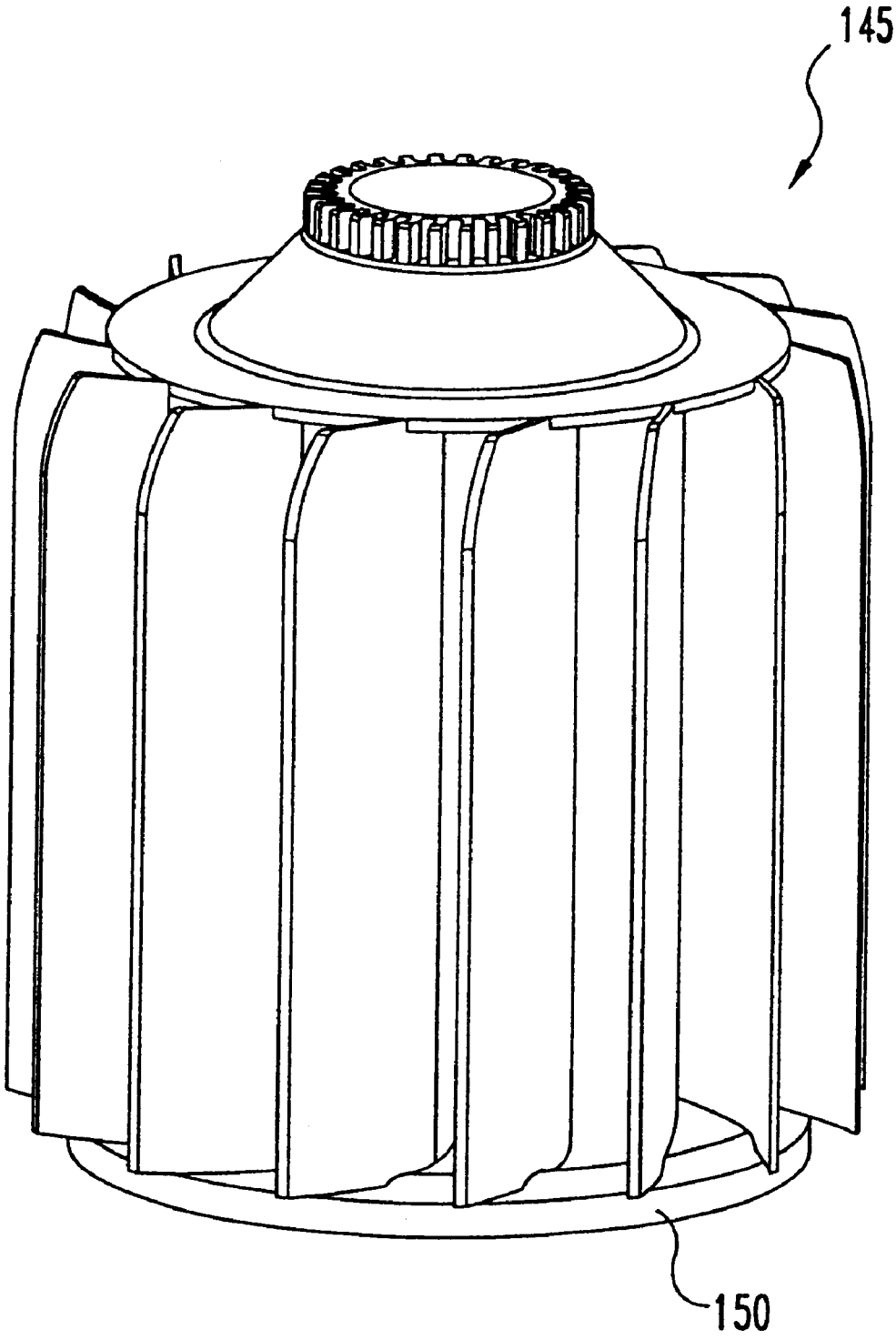
FIG. 15 is a perspective view of a unitary vane module for use in a disposable centrifuge rotor assembly, with a separate base plate shown, according to another embodiment of the present invention.
Figure 16:
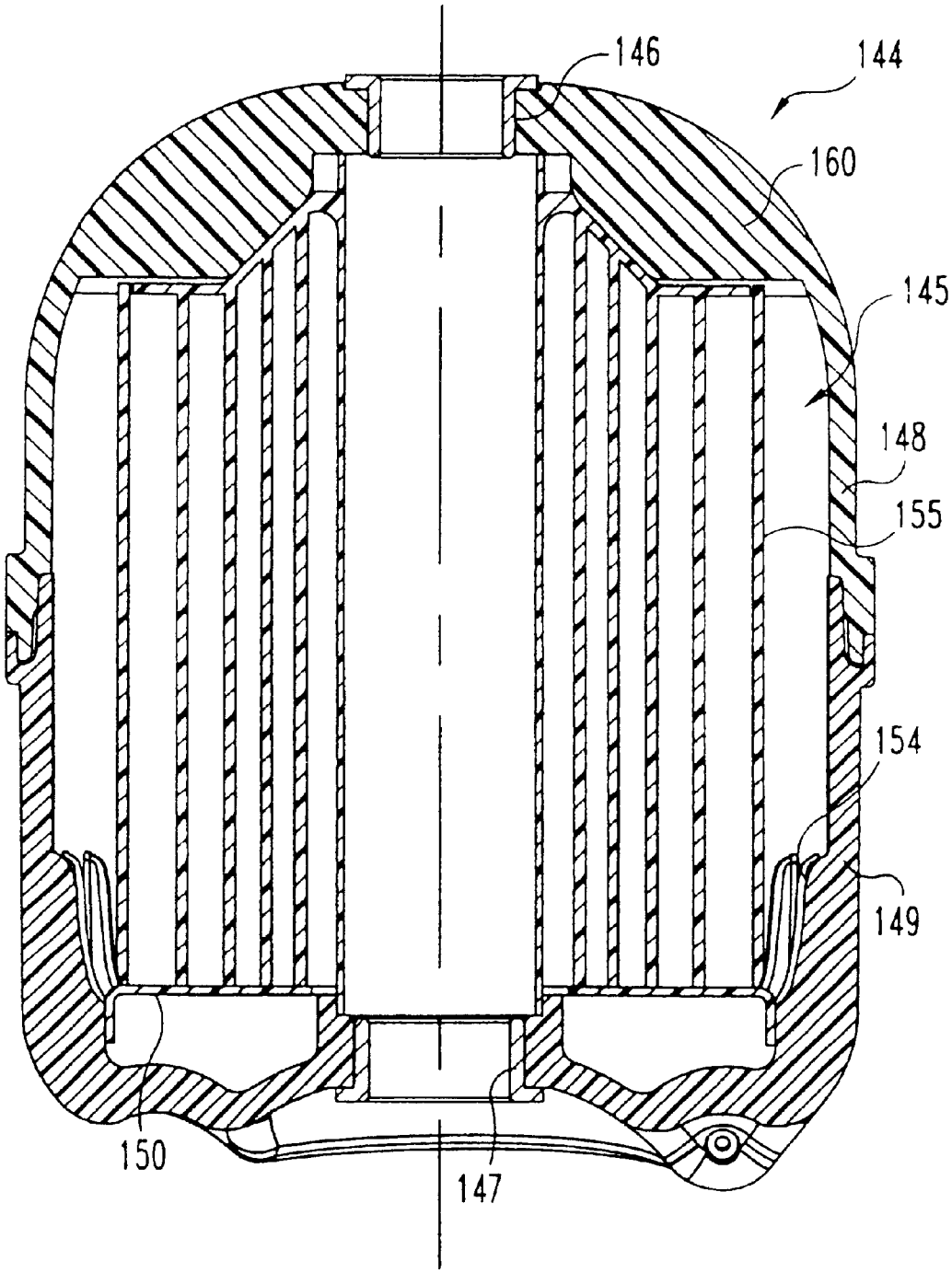
FIG. 16 is a front elevational view in full section of a disposable centrifuge rotor assembly incorporating the FIG. 15 vane module and the separate base plate.

Another embodiment of the present invention is illustrated in FIGS. 15 and 16. What is disclosed is a unitary, separately molded, vane module 145 which is constructed and arranged to assemble into a disposable, self-driven rotor 144. Included in the FIG. 15 and FIG. 16 illustrations is a separate base plate 150. The vane module 145 is a molded plastic component. The other components of the disposable rotor (see FIG. 16) are also molded out of plastic with the exception of the upper bearing 146 and the lower bearing 147. These components of the final disposable rotor assembly 144, in addition to the vane module 145 and the two bearings 146 and 147, include the top rotor shell 148 and the bottom rotor shell 149.

The bottom rotor shell 149 includes a spaced-apart series of ribs 154 which are used to help reduce the concentration of stress that can be present in the transition zone between the sidewall and the bottom, nozzle-end of the rotor. High internal fluid pressure encountered during engine start-up conditions can lead to fatigue and possible cracking of the material if the stress concentration is not reduced by these ribs.

It is preferred to size the spiral vanes 155 of vane module 145 so that they extend into very close proximity to the inner surfaces of the two rotor shell halves. Since this could result in interference with the ribs 154, the rib spacing and vane spacing need to be made compatible to each other in order to avoid interference. In the preferred construction of this illustrated embodiment, the number of ribs and number of vanes in vane module 145 are equal. This allows one vane 155 to be centrally positioned between each pair of adjacent ribs 154. If a different number of vanes 155 is desired, the spacing intervals need to be compatible with the spacing of the ribs in order to preclude any vane-to-rib interference. A selection of a smaller number of vanes from that now illustrated would preferably result in selecting a smaller number of ribs 154. From the perspective of rotor efficiency, as few as fourteen (14) vanes provide something approaching an optimal condition up to as high as twenty-eight (28) vanes.

The selected cutting plane for the FIG. 16 view passes through two opposite flow-directing vanes 160, which are unitary with the top rotor shell 148. It will be understood that between each pair of adjacent rotor vanes 160 there are clearance regions resulting in flow corridors.

With regard to the embodiments illustrated in FIGS. 10–16, it is possible that physical constraints of the injection molding tooling may prevent molding the vanes at the desired vane density due to the long "cores" coupled with the requirement for draft on each vane. One likely solution to this possibility is to mold one half of the vanes integral with the liner shell or top plate, and the remaining one half of the vanes integral with the base plate component The two halves are then nested together by means of a suitable indexing feature, resulting in a vane assembly with the desired vane density.

In the previous embodiments, the vane modules envisioned required a top plate above the vanes so as to properly route the fluid flow in a radially outward direction before entering the vane channels. During development of the present invention, it was discovered through the use of computational fluid dynamics analysis (CFD) that such a flow diverter top plate was not necessary with a "full vane" design. It was discovered that the fluid naturally migrates radially outward without the top plate suffering only a slight reduction in particle separation performance as compared to designs equipped with top plates. The spiral vanes lock the fluid into sectors between the spiral vanes such that the fluid can flow evenly in a radially outward direction. With these sectors, the fluid can maintain its radially outward inertia from the discharge ports. This discovery allowed the inventors the freedom to mold the spiral vanes directly to the top rotor shell. Before this, when it was believed that the top plate was necessary, manufacturing of a unitary spiral vanrotor shell was practically impossible due to a hidden cavity formed between the top plate and the rotor shell.

Figure 17:
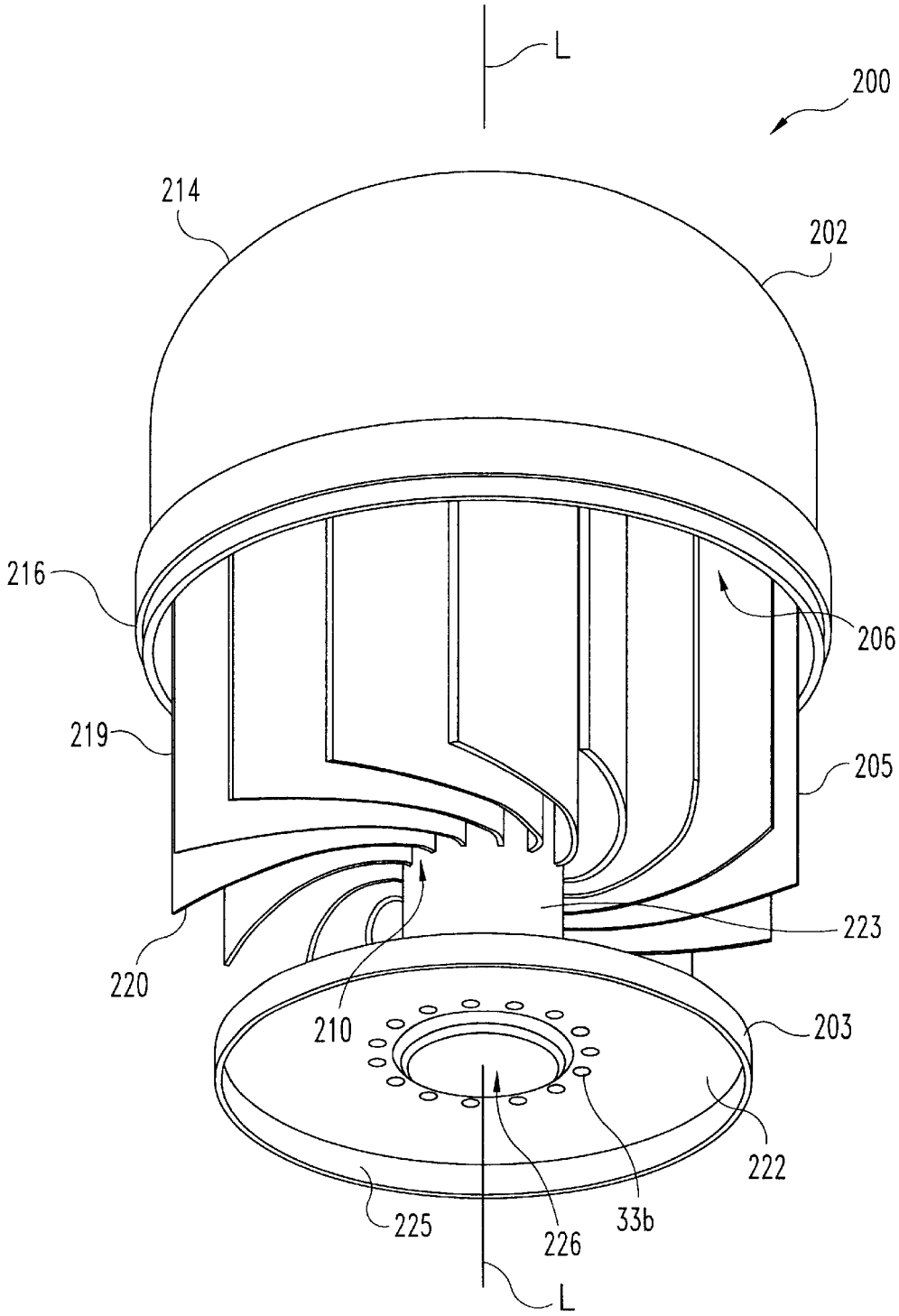
FIG. 17 is a perspective view of a unitary molded spiral vane rotor shell assembled with a base plate according to another embodiment of the present invention.
Figure 18:
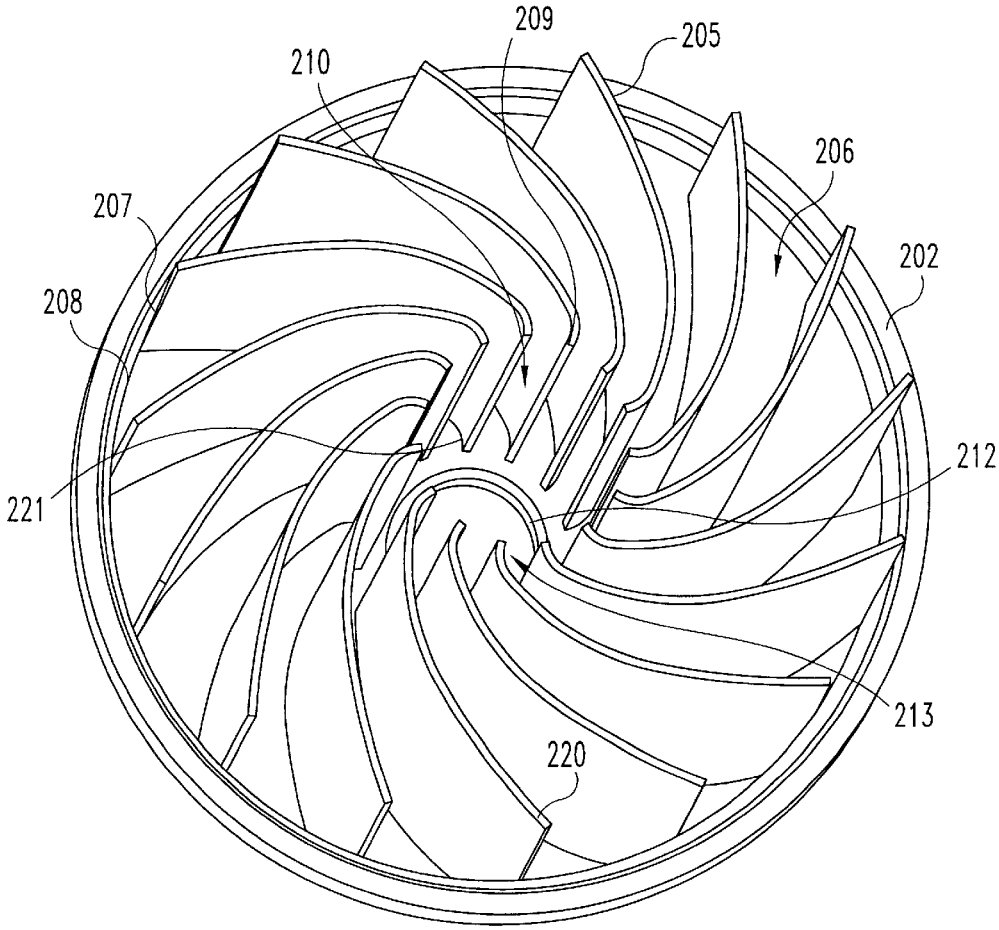
FIG. 18 is a perspective view of the FIG. 17 unitary spiral vane rotor shell.
Figure 19:
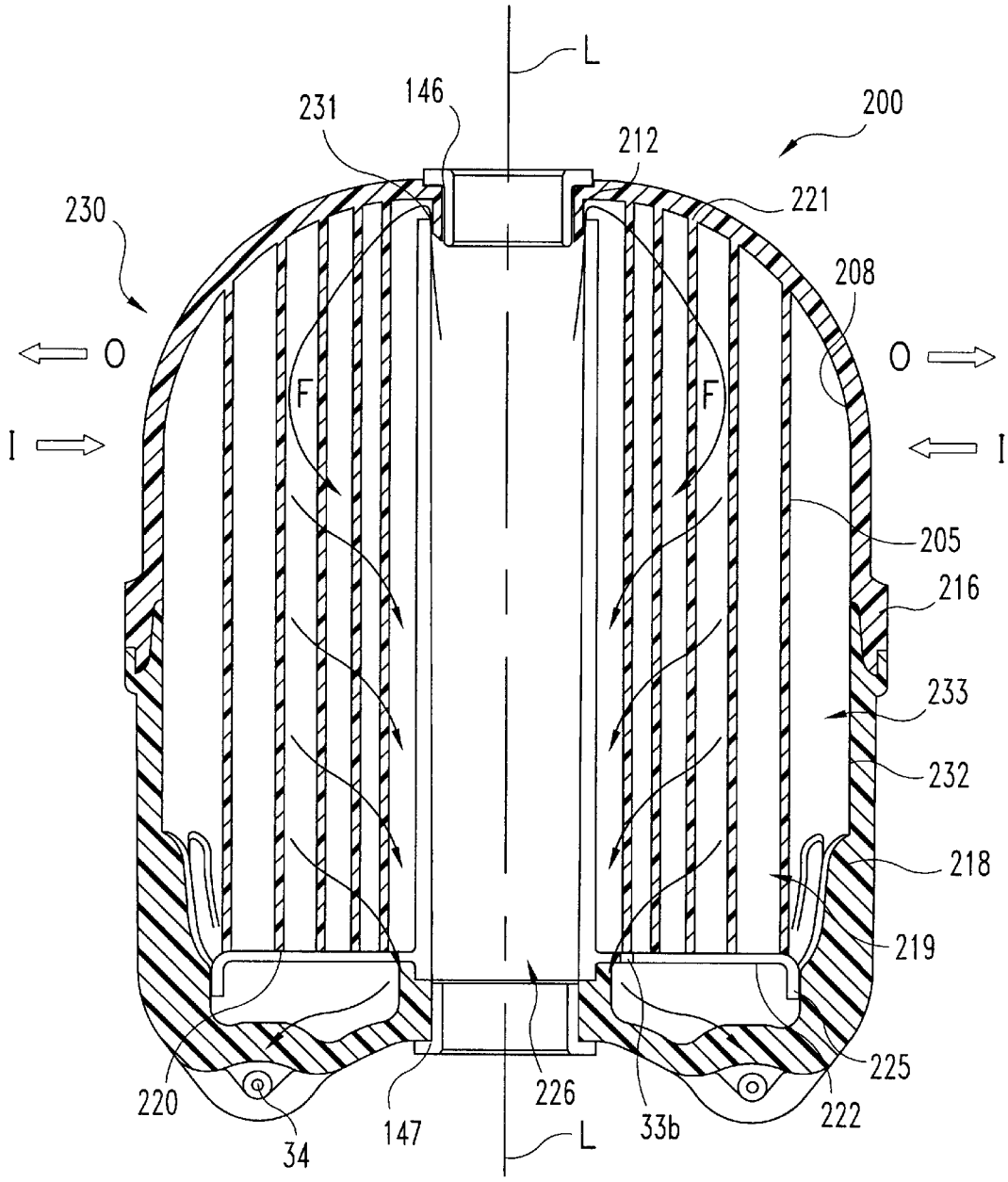
FIG. 19 is a front elevational view in full section of a disposable centrifuge rotor assembly incorporating the FIG. 17 assembly.

A base plate-rotor shell assembly 200 according to another embodiment of the present invention, which incorporates the above discussed design considerations, is illustrated in FIGS. 17–19. In one form, components of assembly 200 are molded from an incinerable plastic such that rotor shell 202 along with the collected sludge can be incinerated after use. It should be appreciated that other materials can be used. As shown in FIG. 17, assembly 200 includes an upper rotor shell 202 and a base plate assembly 203. The rotor shell 202, as illustrated in FIG. 18, has a number of spiral vanes 205 formed in an inner cavity 206 of the upper rotor shell 202. Spiral vanes 205 can be oriented in the same manners as described above, such as having hyper-spiral orientation and/or other angled orientations (FIGS. 7A–C). Assembly 200 is constructed and arranged to rotate about a central longitudinal axis L. As depicted in FIG. 17, the spiral vanes 205 axially extend along this longitudinal axis L of assembly 200. Outer edge portions 207 (FIG. 18) of the spiral vanes 205 are integrally formed with inside surface 208 of the upper rotor shell 202. Opposite the outer edge portion 207, each spiral vane 205 has a free, radially inner edge 209, and together these inner edges 209 define a center tube passage 210. The inside surface 208 further has an annular flange 212 that extends inwardly along a longitudinal axis L in inner cavity 206. The annular flange 212 defines a bearing opening 213 in the rotor shell 202.

In FIG. 17, outside surface 214 of rotor shell 202 has a domed shape. As should be appreciated, the upper rotor shell 202 can have other shapes besides the one shown. The upper rotor shell 202 has an annular engagement edge portion 216, which is adapted to engage a lower rotor shell 218 (FIG. 19). Portions 219 of the spiral vanes 205 extend past engagement edge 216 so as to be received in the lower rotor shell 218. Each of the spiral vanes 205 has a base plate engagement edge 220, which is adapted to engage the base plate 203. At the end opposite the base plate edge 220, each spiral vane 205 has an upper edge portion 221 that is integrally formed with the inside surface 208 of the upper rotor shell 202. Base plate assembly 203, as illustrated in FIG. 17, includes an annular plate portion 222 and a center tube 223. The plate portion 222 has a plurality of clearance holes (fluid exit openings) **33*b* and an outer annular flange 225, which is peripherally located. The center tube 223 is integrally molded as a unitary component with base plate portion 222. It should be appreciated that center tube 223 and base plate portion 222 can be separate components that are joined together, such as through ultrasonic welding, to form a unitary structure. In the illustrated embodiment, center tube 223 and base plate portion 222 are molded from plastic. As shown, the center tube 223 defines a fluid passage 226, which is adapted to transport fluid. As can be seen in FIG. 17, the center tube 223 is slidably received in the center tube passage 226 of the upper rotor shell 202**.

Figure 1A:
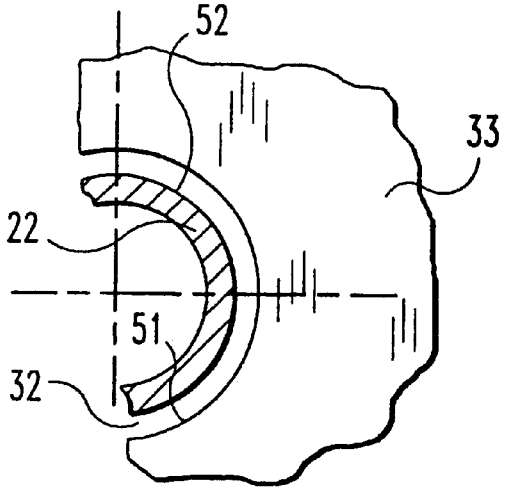
FIG. 1A is a partial, top plan section view of the FIG. 1 centrifuge as viewed along line 1A—1A, with the vanes removed for drawing clarity.
Figure 1B:
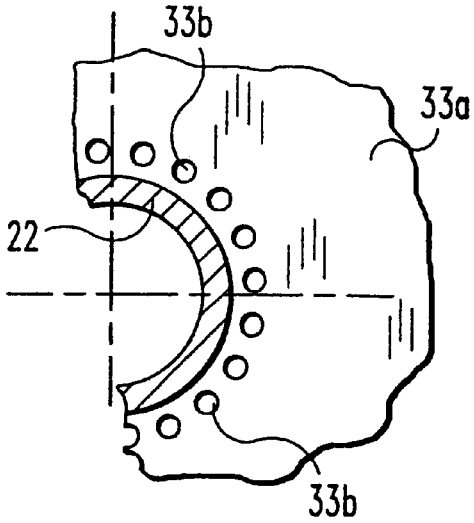
FIG. 1B is a partial, top plan section view of an alternate embodiment of the present invention using the sight line 1A—1A in FIG. 1, with the vanes removed for drawing clarity.

A centrifuge 230 that incorporates rotor shell assembly 200 is illustrated in FIG. 19. When assembled, the engagement edge portion 216 of the upper rotor shell 202 engages with the lower rotor shell 218. As shown, centrifuge 230 further includes oppositely disposed bearings 146 and 147. In the illustrated embodiment, the inner edges 209 of the spiral vanes 205 contact the center tube 223. Fluid flow in the centrifuge 200 during operations is shown by arrows F in FIG. 19. As illustrated, particulate laden fluid travels through fluid passage 226 in the center tube 223. The fluid then flows through a flow inlet 231 that is defined between flange 212 of the rotor shell 202 and the center tube 223. As mentioned above, it was discovered that the fluid will naturally flow in a radially outward direction O even if a diverter plate was not incorporated into centrifuge 230. This allows the spiral vanes 205 to be integrally formed with the rotor shell 202. Due to the inertia of the fluid flow entering at passage 231, the fluid flows in a radially outward direction O from passage 231. By having the spiral vanes 205 integrally formed with the rotor shell 202, fluid rotation relative to the rotor ("lag") in the centrifuge 230 is reduced. Due to the centrifugal forces generated, the particulates suspended in the fluid are deposited on inner wall 232 of rotor shell cavity 233. The inner edges 209 of the spiral vanes 205 contact the center tube 223. The fluid flows in a radially inward direction I, along the center tube 223 and travels out clearance holes **33*b* in the base plate assembly 203. In another form, the fluid flows through annular clearance space 32, which is shown in FIG. 1A. As should be appreciated, the fluid can flow through other types of openings, such as slots. The fluid is then directed to jet flow orifices 34 that are used to drive the centrifuge 230. After the rotor shell assembly 200 is filled with sludge, rotor shell assembly 200 can be replaced with a new one. Once replaced, the old rotor shell assembly 200** can be incinerated or disposed of in other ways.

Both rotor shell 202 and base plate assembly 203 can be formed through molding. After these components are formed, they must be properly cooled in order to ensure, among other things, the proper orientation and shape of the spiral vanes 205. Vane core cooling can become an issue when trying to increase the density of the spiral vanes 205 in rotor shell 202. During ejection from the mold and cooling, support of the spiral vanes 205 may be problematic when a large number of closely spaced vanes are required. If insufficiently supported during cooling, the spiral vanes 205 can become warped or damaged. Misshaping of the spiral vanes 205 can cause reduced particulate separation efficiency and/or rotor imbalance. The spiral vane design shown in FIGS. 20–21 mitigates the core cooling problem by forming some of the spiral vanes on the base plate in order to reduce the spiral vane density on the rotor shell. With this configuration, cooling is improved because the two sets of spiral vanes on the base plate and the rotor shell can be cooled separately. In the embodiment described below, half of the spiral vanes are formed on the base plate and the other half are integrally formed with the rotor shell. However, it should be appreciated that a different ratio of spiral vanes can be formed on each component.

Figure 20:
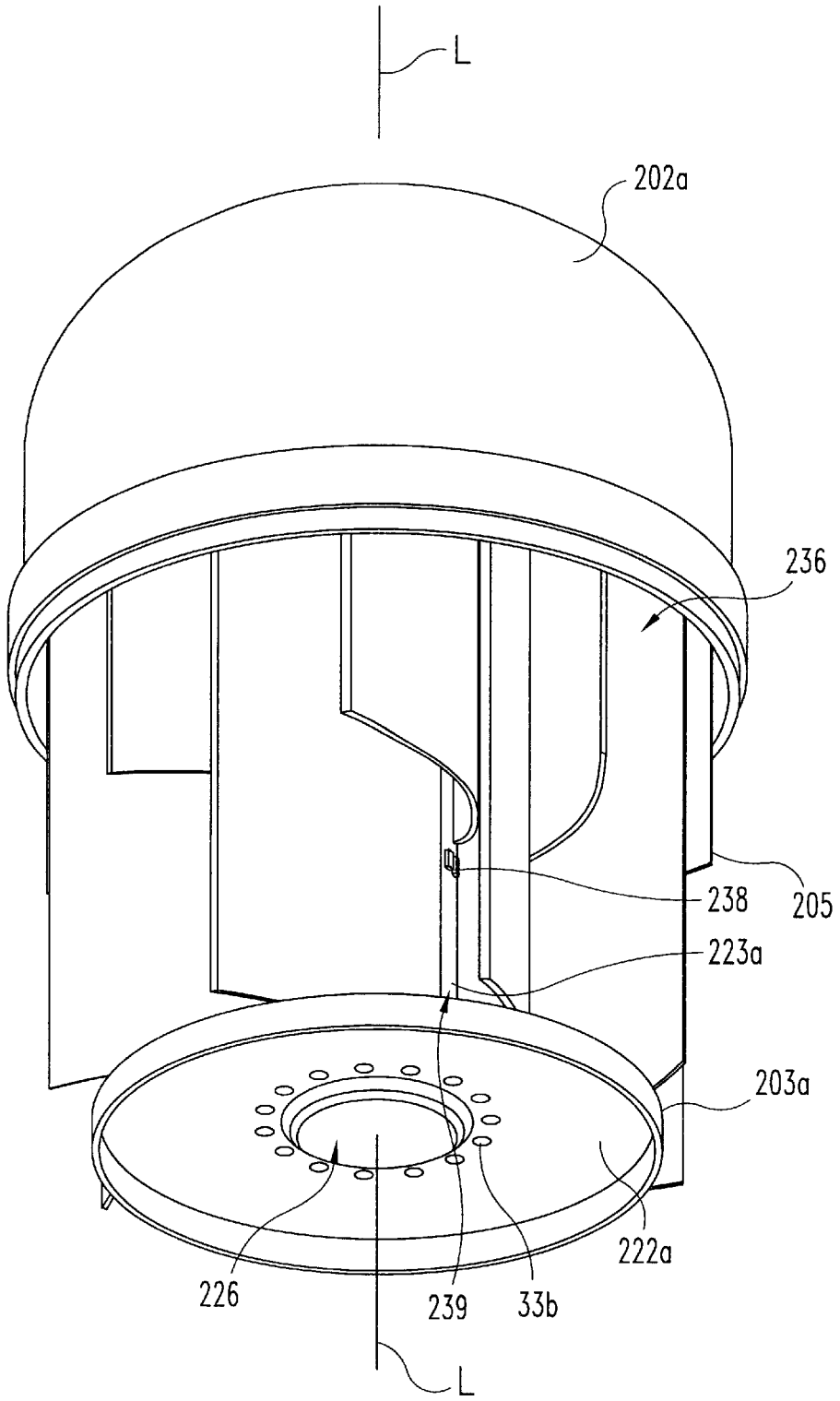
FIG. 20 is a perspective view of an assembly including a rotor shell with unitary spiral vanes and a base plate with nested unitary spiral vanes according to a further embodiment of the present invention.
Figure 21:
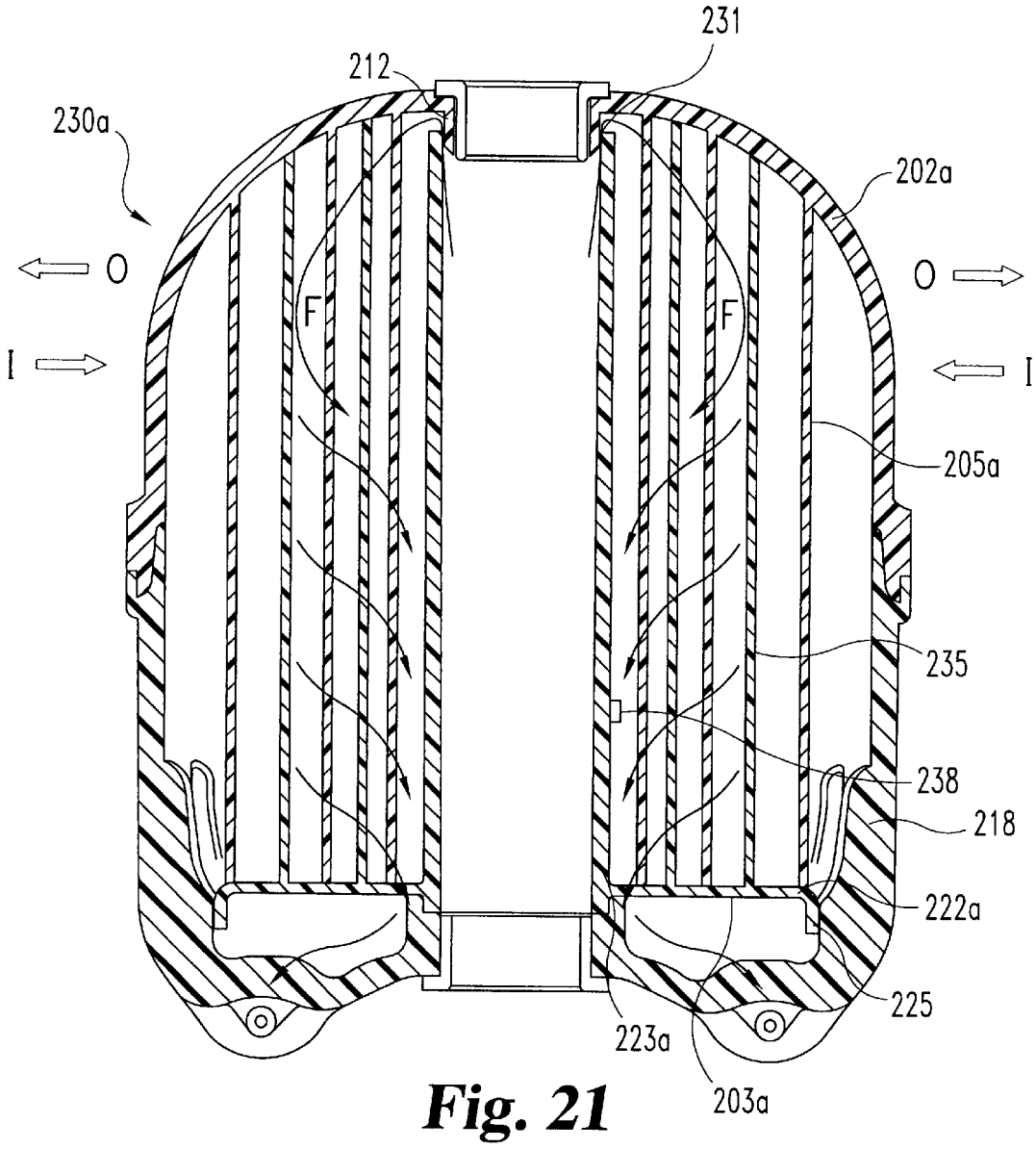
FIG. 21 is a front elevational view in full section of a disposable centrifuge rotor assembly incorporating the FIG. 20 assembly.

As shown in FIG. 20, rotor shell 202*a* includes a number of similar components as described above. As illustrated, upper rotor shell 202*a* includes several integrally formed spiral vanes 205*a*, which can be spirally oriented in the manners as described above. Base plate assembly 203*a* includes a base plate portion 222*a* and an integrally formed center tube 223*a*. The base plate portion 222*a* has one or more flow exit openings 33*b* defined therein. In this embodiment, the base plate assembly 203*a* has several base plate spiral vanes 235 integrally formed with both the base plate portion 222*a* and the center tube 223*a*. As illustrated in FIG. 20, the base plate spiral vanes 235 are adapted to nest between the spiral vanes 205 of rotor shell 202*a*. Base plate spiral vanes 235 are nested in spiral vane spaces 236 that are defined between adjacent spiral vanes 205*a*. The center tube 223*a* further has a pair of alignment protrusions 238 that are used to align the two sets of spiral vanes 205 and 235. The aligned protrusions 238 define a vane channel 239 in which one of the spiral vane 205 of rotor shell 202*a* is received. This ensures that spiral vanes 205 and 235 are properly aligned and evenly spaced. Once assembled, as shown in FIG. 21, centrifuge 230*a* operates in the same fashion as described above. With the increased density of spiral vanes in centrifuge 230*a*, particulate separation can be maximized.

Figure 22:
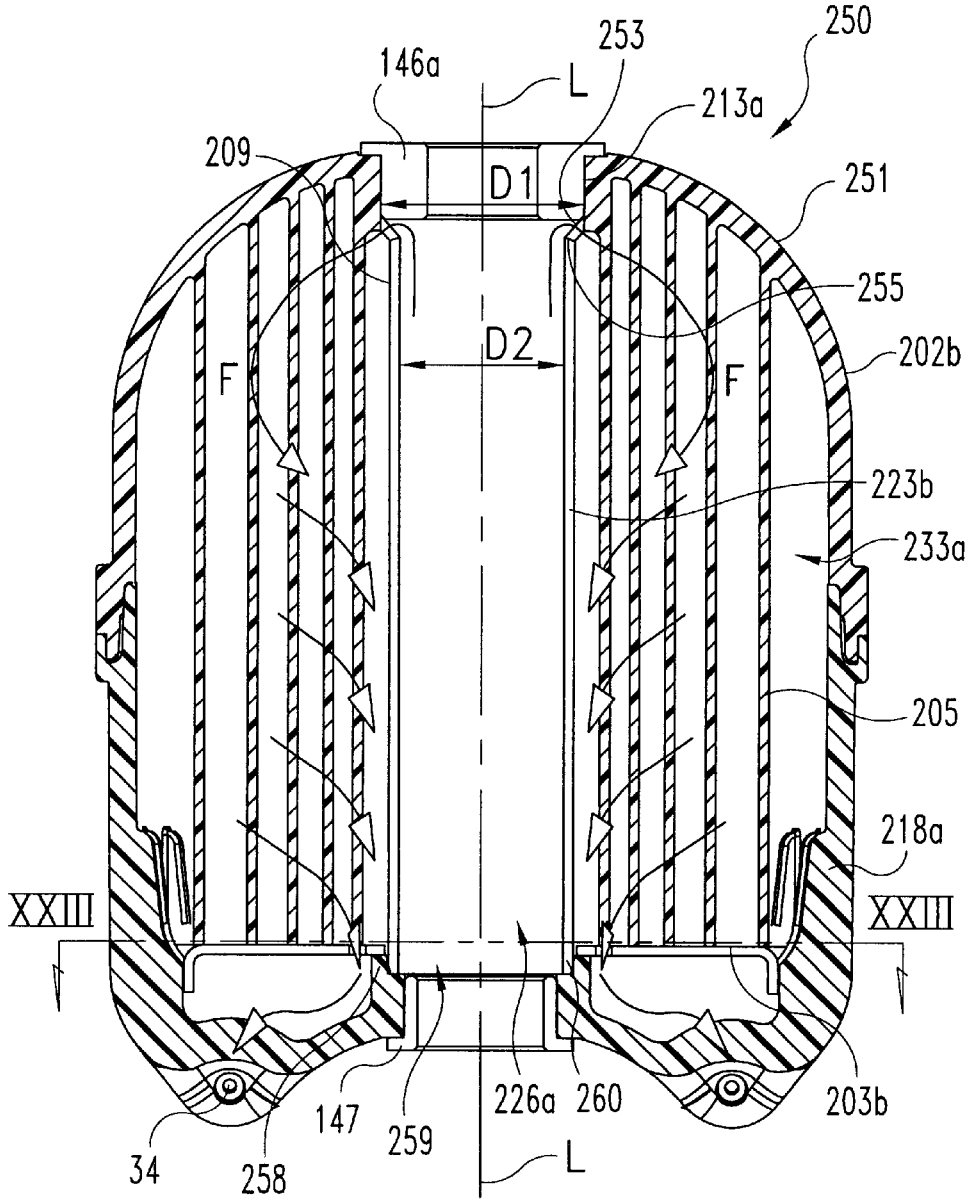
FIG. 22 is a front elevational view in full section of a disposable centrifuge rotor assembly incorporating a rotor shell with unitary spiral vanes and a center tube according to another embodiment of the present invention.
Figure 23:
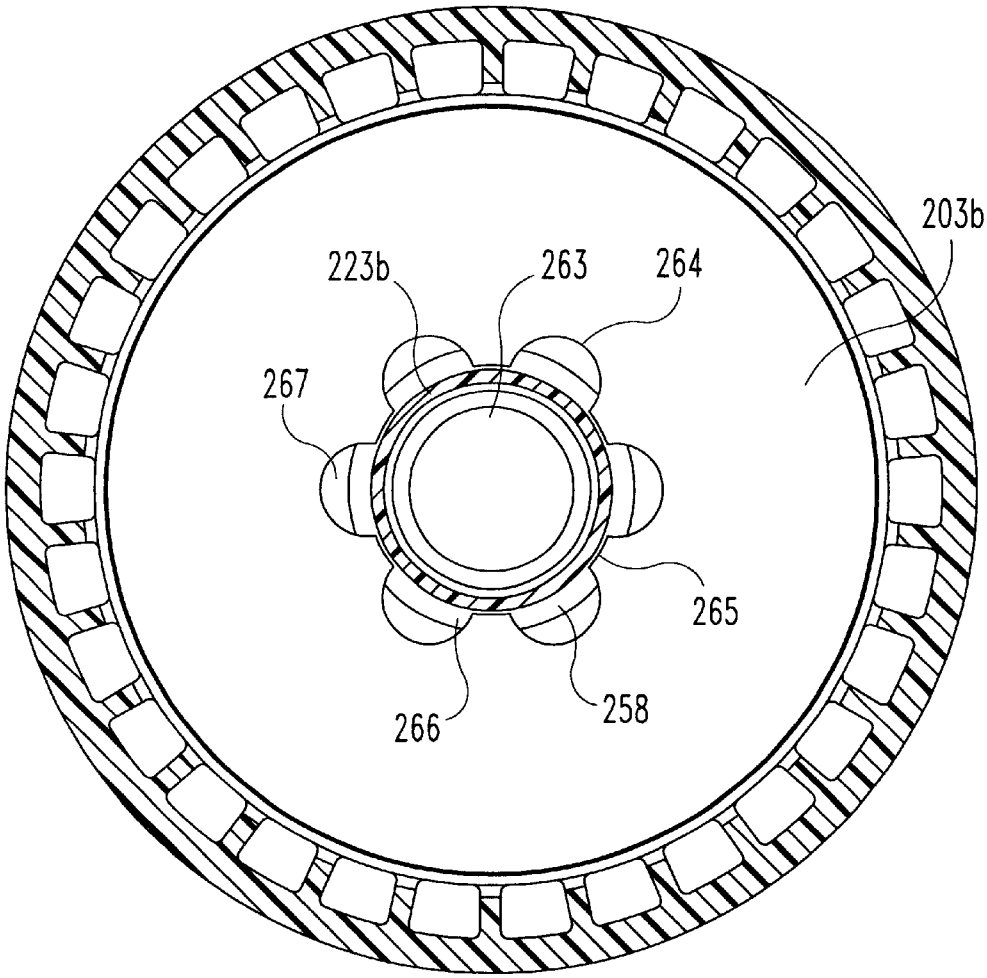
FIG. 23 is a partial, top plan section view of the FIG. 22 centrifuge as viewed along line XXIII—XXIII, with the vanes removed for the sake of clarity.

A centrifuge 250 that incorporates a rotor shell assembly 251 according to another embodiment of the present invention is illustrated in FIGS. 22–23. As depicted in FIG. 22, the rotor shell assembly 251 includes an upper rotor shell 202*b* that is mated with a lower rotor shell 218*a*. The centrifuge 250 further includes a pair of oppositely disposed bearings 146*a* and 147. Bearing 146*a* is received in a bearing opening 213*a* that is defined in the upper rotor shell 202*b*. The upper rotor shell 202*b* has a plurality of spiral vanes 205 integrally formed therein. Instead of having center tube 223*b* integrally formed with base plate 203*b*, the center tube 223*b* in the illustrated embodiment is integrally formed with the upper rotor shell 202*b*. The center tube 223*b* includes an angled transition portion 253 at which the center tube 223*b* is attached to the upper rotor shell 202*b*, and multiple fluid inlet ports (openings) 255 are defined in the transition portion 253. Fluid inlet ports 255 are constructed and arranged to allow fluid to flow from inner passage 226*a* out ports 253 into rotor shell cavity 233*a*. As illustrated, bearing 146*a* has an outer diameter that is larger than bearing 147 such that diameter D1 of the bearing opening 213*a* is larger than diameter D2 of the inner passage 226*a*. This allows the fluid inlet ports 255 to be formed in the center tube 223*b* during molding without requiring special inserts to form the ports 255. The lower rotor shell 218*a* has an annular base plate support flange 258 that defines a center tube receiving cavity 259. As illustrated, an end portion 260 of the center tube 223*b* is received in cavity 259.

FIG. 23 is a partial, top plan section view of centrifuge 250 as viewed along line XXIII—XXIII in FIG. 22, with the spiral vanes 205 removed for the sake of clarity. As illustrated, the base plate 203*b* has a central opening 263 with semi-circular serrations 264 radially defined therein around the center tube 223*b*. A discontinuous gap 265 is defined between the center tube 223*b* and the base plate 203*b*. As shown in FIG. 23, the base plate support flange 258 of the lower rotor shell 218*a* blocks an annular portion 266 of the serrated gap 265 while leaving portion 267 of the serrations 264 open. During operation, the fluid flows through the serrations 264 and out jet flow orifice 34 in the lower rotor shell 218*a*.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge, comprising:

a base plate;

a center tube extending along a longitudinal axis, said center tube being constructed and arranged to deliver fluid; and a rotor shell and said base plate defining an inner cavity, said rotor shell having a plurality of spiral vanes extending along said longitudinal axis within said inner cavity and extending in a spiral orientation around said center tube, wherein said vanes are integrally formed with said rotor shell.

2. The centrifuge of claim 1, wherein said base plate has one or more fluid outlet openings defined therein around said center tube.

3. The centrifuge of claim 1, wherein said center tube and said base plate define a clearance space.

4. The centrifuge of claim 3, wherein said clearance space includes a serrated gap that has a plurality of radially disposed annular serrations.

5. The centrifuge of claim 1, wherein said center tube is integrally formed with said base plate.

6. The centrifuge of claim 1, wherein said center tube is integrally formed with said rotor shell.

7. The centrifuge of claim 1, wherein said base plate includes a plurality of base plate spiral vanes integrally formed thereon, said base plate vanes being nested between adjacent ones of said spiral vanes of said rotor shell.

8. The centrifuge of claim 7, wherein said spiral vanes of said rotor shell and said base plate spiral vanes are equal in number.

9. The centrifuge of claim 7, wherein said center tube has at least a pair of alignment protrusions constructed and arranged to align said base plate spiral vanes in a nesting relationship with said spiral vanes of said rotor shell.

10. The centrifuge of claim 1, wherein said rotor shell has a domed shape.

11. The centrifuge of claim 1, wherein said rotor shell includes an upper rotor shell positioned above said base plate.

12. The centrifuge of claim 11, further comprising a lower rotor shell mated with said upper rotor shell.

13. The centrifuge of claim 12, wherein said spiral vanes extend within said lower rotor shell.

14. The centrifuge of claim 1, wherein said spiral vanes have a hyper-spiral shape.

15. The centrifuge of claim 1, wherein said rotor is formed of plastic.

16. The centrifuge of claim 1, wherein:

said rotor shell has an annular flange extending in said inner cavity; and said annular flange and said center tube define a fluid inlet for delivering the fluid into said inner cavity.

17. A rotor shell for a centrifuge, comprising:

an outer shell portion having an annular engagement edge, said outer shell portion defining an inner cavity, said outer shell having a longitudinal axis; and a plurality of spiral vanes integrally formed with said outer shell, said spiral vanes extending spirally in said inner cavity and extending along said longitudinal axis.

18. The rotor shell of claim 17, wherein said spiral vanes each include a portion extending along said longitudinal axis past said engagement edge.

19. The rotor shell of claim 18, wherein said spiral vanes have a hyper-spiral shape.

20. The rotor shell of claim 17, wherein said outer shell portion has a domed shape.

21. The rotor shell of claim 17, further comprising a center tube attached to said outer shell portion.

22. A method of manufacturing a centrifuge, comprising:

molding a rotor shell with a plurality of spiral vanes integrally formed with the rotor shell, wherein the rotor shell defines an inner cavity and the spiral vanes extend spirally in the inner cavity, wherein the spiral vanes have inner edges that define a center tube passage;

providing a base plate with a center tube; and inserting the center tube in the center tube passage.

23. The method of claim 22, wherein:

said providing the base plate includes molding a plurality of base plate spiral vanes integrally with the base plate; and said inserting the center tube includes nesting the base plate spiral vanes within said spiral vanes of the rotor shell.

24. The method of claim 23, further comprising mating the rotor shell with a second rotor shell to enclose the base plate therein.

25. The method of claim 23, further comprising cooling the rotor shell and the base plate separately.

26. The method of claim 22, wherein:

said providing the base plate includes molding a plurality of base plate spiral vanes integrally with the center tube; and said inserting the center tube includes nesting the base plate spiral vanes within said spiral vanes of the rotor shell.

27. A rotor shell for a centrifuge, comprising:

an outer shell defining an inner cavity, said outer shell having a longitudinal axis; and a plurality of spiral vanes extending along said longitudinal axis, said spiral vanes extending inside said inner cavity in a spiral orientation around said longitudinal axis, said spiral vanes each having an inner edge portion radially located proximal said longitudinal axis and an outer edge portion radially located distal said longitudinal axis, said outer edge portion being attached to said outer shell.

28. The rotor shell of claim 27, further comprising a tube attached to said inner edge portion of each of said spiral vanes to supply fluid into said inner cavity.

29. The rotor shell of claim 27, wherein:

said outer shell has an engagement edge to secure said outer shell to another component; and said spiral vanes each include a portion extending along said longitudinal axis past said engagement edge.

* * * * *